US010688511B2

(12) United States Patent
Hegdahl et al.

(10) Patent No.: US 10,688,511 B2
(45) Date of Patent: Jun. 23, 2020

(54) WIDE-MOUTHED FLUID CONNECTOR FOR HAND-HELD SPRAY GUNS

(71) Applicant: 3M INNOVATIVE PROPERTIES COMPANY, St. Paul, MN (US)

(72) Inventors: Anna M. Hegdahl, Brooklyn Park, MN (US); Stephen C. P. Joseph, Woodbury, MN (US); Alexander T. Ebertowski, Burnsville, MN (US); Andrew R. Henry, Leicestershire (GB)

(73) Assignee: 3M Innovative Properties Company, St. Paul, MN (US)

( * ) Notice: Subject to any disclaimer, the term of this patent is extended or adjusted under 35 U.S.C. 154(b) by 46 days.

(21) Appl. No.: 16/069,840

(22) PCT Filed: Jan. 12, 2017

(86) PCT No.: PCT/US2017/013127

§ 371 (c)(1),
(2) Date: Jul. 12, 2018

(87) PCT Pub. No.: WO2017/123714

PCT Pub. Date: Jul. 20, 2017

(65) Prior Publication Data

US 2019/0015858 A1 Jan. 17, 2019

Related U.S. Application Data

(60) Provisional application No. 62/279,619, filed on Jan. 15, 2016.

(51) Int. Cl.
*B05B 7/24* (2006.01)

(52) U.S. Cl.
CPC ..... *B05B 7/2478* (2013.01); *B05B 7/2408* (2013.01)

(58) Field of Classification Search
CPC ..... B05B 7/2478; B05B 7/2408
(Continued)

(56) References Cited

U.S. PATENT DOCUMENTS 1,395,965 A 11/1921 McLean
1,732,691 A 10/1929 Mueller
(Continued)

FOREIGN PATENT DOCUMENTS

CA 2466801 12/2004
DE 890223 9/1953
(Continued)

OTHER PUBLICATIONS

Devilbiss, "Gunner Cup", 803442/DMK-1500, conversion adapter, p. 1.
(Continued)

*Primary Examiner* — Steven J Ganey

(57) ABSTRACT

A spray gun reservoir connector system. The system includes a reservoir lid, a spray gun inlet, and complementary first and second connector formats. The first and second connector formats are provided with one of either the lid or the spray gun inlet. The first format includes a plurality of retention structures each defining a capture region. The retention structures are collectively arranged in a circular pattern. The second format includes a plurality of lock structures each including a shim body configured to selectively interface with the capture regions. The connector formats are configured to provide wedged engagement between the lock structures and corresponding ones of the retention structures upon rotation of the spray gun inlet relative to the lid. The lid may include a spout. The retention and lock structures are radially spaced outside of the spout, and the spout may have an inner diameter of not less than 22 mm.

17 Claims, 30 Drawing Sheets

(58) Field of Classification Search
USPC ..... 239/302, 346, 379, 525
See application file for complete search history.

(56) References Cited

U.S. PATENT DOCUMENTS

| | | | |
|---|---|---|---|
| 1,968,173 | A | 7/1934 | Russell |
| 2,004,574 | A | 6/1935 | Gee, Jr. |
| 2,037,240 | A | 4/1936 | Johnson |
| 3,083,883 | A | 4/1963 | Glidden |
| D200,960 | S | 4/1965 | Beinert |
| 3,271,059 | A | 9/1966 | Pearson |
| D217,609 | S | 5/1970 | Vicknair |
| 3,942,680 | A | 3/1976 | Seeley |
| D252,156 | S | 6/1979 | Tabony |
| 4,858,777 | A | 8/1989 | Morel |
| D315,781 | S | 3/1991 | Hart |
| 5,150,804 | A | 9/1992 | Blanchet |
| 5,240,133 | A | 8/1993 | Thomas, Jr. |
| 5,611,443 | A | 3/1997 | King |
| 6,053,429 | A | 4/2000 | Chang |
| 6,375,031 | B1 | 4/2002 | Kwan |
| 6,435,426 | B1 | 8/2002 | Copp, Jr. |
| 6,536,687 | B1 | 3/2003 | Navis |
| 6,547,161 | B1 | 4/2003 | Huang |
| D474,528 | S | 5/2003 | Huang |
| 6,588,681 | B2 | 7/2003 | Rothrum et al. |
| 6,595,441 | B2 | 7/2003 | Petric |
| 6,662,411 | B2 | 12/2003 | Rubenstein |
| 6,938,836 | B2 | 9/2005 | Bouic |
| 6,953,155 | B2 | 10/2005 | Joseph |
| 7,032,839 | B2 | 4/2006 | Blette |
| 7,036,752 | B1 | 5/2006 | Hsiang |
| 7,083,119 | B2 | 8/2006 | Bouic |
| 7,188,785 | B2 | 3/2007 | Joseph |
| D542,376 | S | 5/2007 | Blette |
| 7,353,973 | B2 | 4/2008 | Rohr |
| D574,926 | S | 8/2008 | Huang |
| 7,410,106 | B2 | 8/2008 | Escoto, Jr. |
| 7,416,140 | B2 | 8/2008 | Camilleri |
| 7,513,443 | B2 | 4/2009 | Escoto, Jr. |
| D607,807 | S | 1/2010 | Ohlhorst |
| 7,694,896 | B2 | 4/2010 | Turnbull |
| D616,961 | S | 6/2010 | Goetz |
| 7,789,324 | B2 | 9/2010 | Bouic |
| 7,819,341 | B2 | 10/2010 | Schmon |
| D640,587 | S | 6/2011 | Tanaka |
| D642,863 | S | 8/2011 | Tobias |
| 8,016,209 | B2 | 9/2011 | Hess |
| 8,033,413 | B2 | 10/2011 | Gerson |
| 8,066,205 | B2 | 11/2011 | Bass |
| D656,583 | S | 3/2012 | Hudson, Jr. |
| 8,127,963 | B2 | 3/2012 | Gerson |
| 8,196,770 | B2 | 6/2012 | Kosmyna |
| D679,146 | S | 4/2013 | Rincon |
| 8,444,067 | B2 | 5/2013 | Schmon |
| D692,530 | S | 10/2013 | Gehrung |
| 8,590,809 | B2 | 11/2013 | Escoto, Jr. |
| D697,583 | S | 1/2014 | Schmon |
| D705,899 | S | 5/2014 | Abernethy |
| 8,844,840 | B2 | 9/2014 | Lawrence |
| 8,857,649 | B2 | 10/2014 | Buchholz |
| D717,104 | S | 11/2014 | Redfern |
| D719,637 | S | 12/2014 | Pagliai |
| 8,925,836 | B2 | 1/2015 | Dettlaff |
| 8,944,351 | B2 | 2/2015 | Pellegrino |
| 8,998,018 | B2 | 4/2015 | Pellegrino |
| 9,038,674 | B2 | 5/2015 | Steele |
| D739,242 | S | 9/2015 | Pitera |
| 9,162,240 | B2 | 10/2015 | Gerson |
| 9,174,231 | B2 | 11/2015 | Shultz |
| D747,497 | S | 1/2016 | Bell |
| 9,227,208 | B2 | 1/2016 | Lin |
| D755,345 | S | 5/2016 | Lüthi |
| D755,575 | S | 5/2016 | Pratt |
| 9,335,198 | B2 | 5/2016 | Pellegrino |
| D758,533 | S | 6/2016 | Dettlaff |
| D779,632 | S | 2/2017 | Johnson |
| 9,586,220 | B2 | 3/2017 | Pellegrino |
| D792,556 | S | 7/2017 | Hegdahl |
| D793,530 | S | 8/2017 | Hegdahl |
| D793,531 | S | 8/2017 | Hegdahl |
| 9,815,076 | B2 | 11/2017 | Schulz |
| D811,525 | S | 2/2018 | Hegdahl |
| 2003/0006310 | A1 | 1/2003 | Rothrum |
| 2003/0198502 | A1 | 10/2003 | Maloney |
| 2004/0256484 | A1 | 12/2004 | Joseph |
| 2005/0092770 | A1 | 5/2005 | Yechouron |
| 2005/0139621 | A1 | 6/2005 | Foster |
| 2005/0156058 | A1 | 7/2005 | Kosmyna |
| 2006/0000927 | A1 | 1/2006 | Ruda |
| 2006/0175433 | A1 | 8/2006 | Escoto, Jr. |
| 2006/0196891 | A1 | 9/2006 | Gerson |
| 2006/0251473 | A1 | 11/2006 | Tyski |
| 2007/0158348 | A1 | 7/2007 | Kosmyna |
| 2007/0158361 | A1 | 7/2007 | Koyama |
| 2007/0272323 | A1 | 11/2007 | Verhaeghe |
| 2008/0011879 | A1 | 1/2008 | Gerson |
| 2008/0223087 | A1 | 9/2008 | Veldman |
| 2009/0200309 | A1 | 8/2009 | Kosmyna |
| 2010/0288772 | A1 | 11/2010 | Wambeke |
| 2010/0288787 | A1 | 11/2010 | Jäckel |
| 2011/0108579 | A1 | 5/2011 | Martorell Pena |
| 2012/0000992 | A1 | 1/2012 | Shih |
| 2012/0273583 | A1 | 11/2012 | Gerson |
| 2012/0279609 | A1 | 11/2012 | Pellegrino |
| 2012/0282009 | A1 | 11/2012 | Geuther |
| 2012/0291890 | A1 | 11/2012 | Pan |
| 2013/0001322 | A1 | 1/2013 | Pellegrino |
| 2013/0105598 | A1 | 5/2013 | Schultz |
| 2013/0153683 | A1 | 6/2013 | Lawrence |
| 2013/0186981 | A1 | 7/2013 | Burns |
| 2013/0221130 | A1 | 8/2013 | Joseph |
| 2014/0014741 | A1 | 1/2014 | Escoto, Jr. |
| 2014/0103143 | A1 | 4/2014 | Lin |
| 2014/0178126 | A1 | 6/2014 | Burns |
| 2014/0203098 | A1 | 7/2014 | Bierie |
| 2015/0060568 | A1 | 3/2015 | Johnson |
| 2015/0108135 | A1 | 4/2015 | Hanna |
| 2015/0360812 | A1 | 12/2015 | Gerson |
| 2016/0052002 | A1 | 2/2016 | Schulz |
| 2016/0271632 | A1 | 9/2016 | Bierie |
| 2016/0303594 | A1 | 10/2016 | Nyaribo |
| 2017/0203887 | A1 | 7/2017 | Hegdahl |

FOREIGN PATENT DOCUMENTS

| | | |
|---|---|---|
| DE | 8902223.8 | 5/1989 |
| DE | 20202123 | 2/2003 |
| DE | 202004003116 | 7/2005 |
| DE | 102007039106 | 2/2009 |
| DE | 102009034715 | 1/2011 |
| EP | 1566223 | 8/2005 |
| EP | 2383044 | 11/2011 |
| EP | 2450108 | 5/2012 |
| EP | 2982443 | 2/2016 |
| JP | 3052058 | 9/1998 |
| NL | 1033999 | 2/2009 |
| WO | WO 1998-32539 | 7/1998 |
| WO | WO 2003-045575 | 6/2003 |
| WO | WO 2004-037433 | 5/2004 |
| WO | WO 2004-052552 | 6/2004 |
| WO | WO 2005-018815 | 3/2005 |
| WO | WO 2008-156357 | 12/2008 |
| WO | WO 2009-090273 | 6/2009 |
| WO | WO 2011-047876 | 4/2011 |
| WO | WO 2014-182722 | 11/2014 |
| WO | WO 2014-182871 | 11/2014 |
| WO | WO 2016-081977 | 6/2016 |
| WO | WO 2017-123708 | 7/2017 |
| WO | WO 2017-123709 | 7/2017 |

(56) References Cited

FOREIGN PATENT DOCUMENTS

| | | |
|---|---|---|
| WO | WO 2017-123714 | 7/2017 |
| WO | WO 2017-123715 | 7/2017 |

OTHER PUBLICATIONS

Graco, "CanConnect-Handheld 1 Quart Can Adapter," Feb. 2014, 2pgs.
Graco, "XFORCE HD, Heavy Duty Cordless Airless Sprayer Optimized for Protective and Marine Coatings", 2012, 4 pgs.
Kenna, "Eccentricity in Ellipses", Mathematics Magazine, Jan.-Feb. 1959, vol. 32, No. 3, pp. 133-135.
Otto House, p. 1, Photograph of Otto House Product; Dated 2013.
Rummy Recycling Technologies Inc., "Paint & Solvent Solutions" brochure with price list, 2004.
Rummy Recycling Technologies Inc., "Paint & Solvent Solutions" Photograph, scanned in Feb. 2006.
International Search report for PCT International Application No. PCT/US2017/013127 dated Jun. 13, 2017, 6 pages.
Yotoriyama "Coating with Paint of Partner," pages from catalog, 2000.

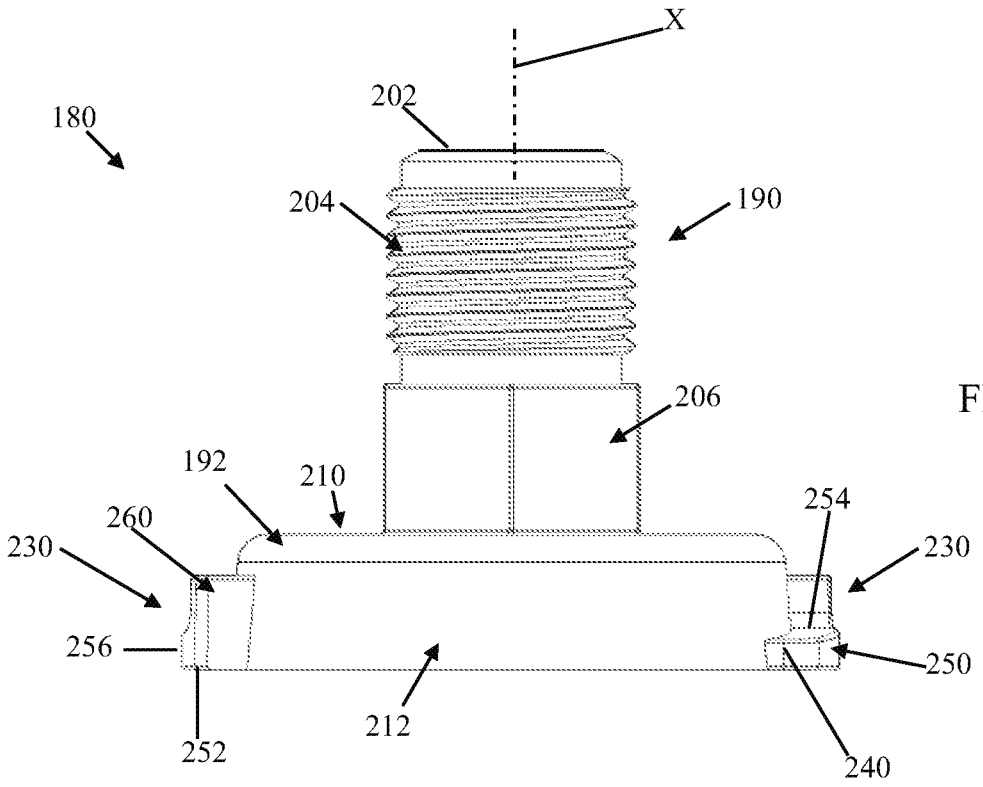
FIG. 5C
FIG. 5D
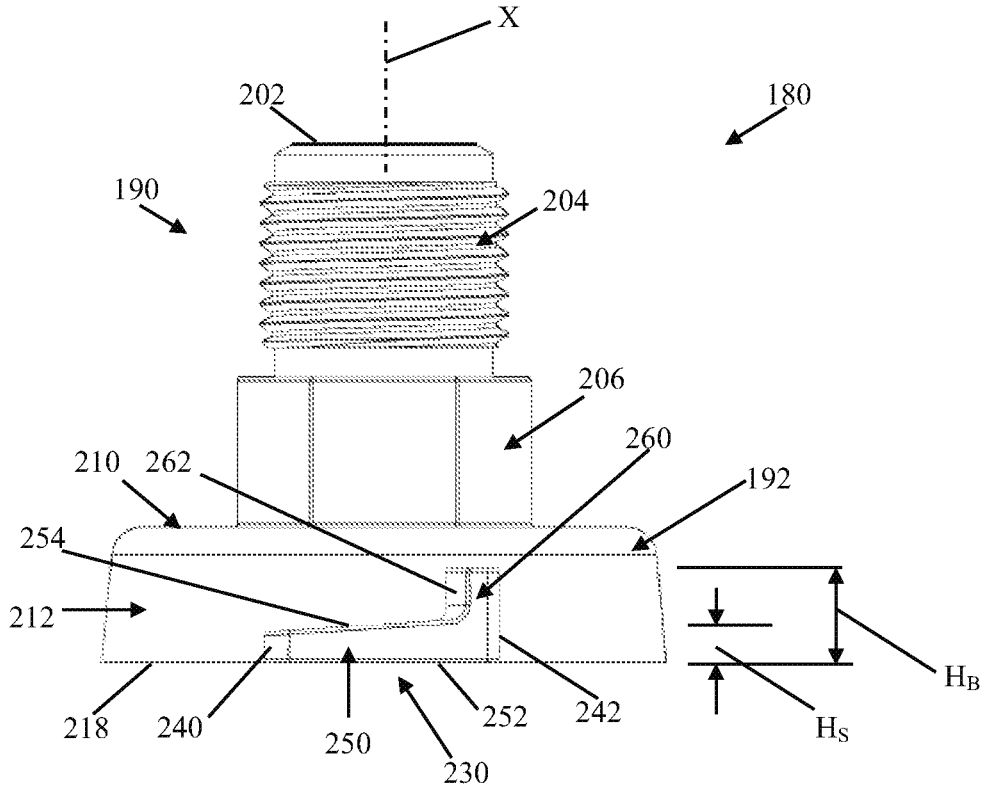

WIDE-MOUTHED FLUID CONNECTOR FOR HAND-HELD SPRAY GUNS

CROSS REFERENCE TO RELATED APPLICATIONS

This application is a national stage filing under 35 U.S.C. 371 of PCT/US2017/013127, filed Jan. 12, 2017, which claims the benefit of U.S. Application No. 62/279,619, filed Jan. 15, 2016, the disclosure of which is incorporated by reference in its/their entirety herein.

BACKGROUND

The present disclosure relates to liquid spraying apparatuses, such as spray guns. More particularly, it relates to the connection between a spray gun and a reservoir containing the liquid to be sprayed.

Spray guns are widely used in vehicle body repair shops when re-spraying a vehicle that has been repaired following an accident. In the known spray guns, the liquid is contained in a reservoir attached to the gun from where it is fed to a spray nozzle. On emerging from the spray nozzle, the liquid is atomized and forms a spray with compressed air supplied to the nozzle. The liquid may be gravity fed or suction fed or, more recently, pressure fed by an air bleed line to the reservoir from the compressed air line to the spray gun, or from the spray gun itself.

SUMMARY

Traditionally, the liquid is contained in a rigid reservoir or pot removably mounted on the spray gun. In this way, the pot can be removed for cleaning or replacement. Previously, the pot was secured to the gun empty and provided with a removable lid by which the desired liquid could be added to the pot while attached to the gun. On completion of spraying, the pot can be removed and the gun and pot cleaned for re-use.

More recently, reservoir assemblies have been developed that enables painters to mix less paint and drastically reduce the amount of technician time required for gun cleaning. The PPS™ Paint Preparation System available from 3M Company of St. Paul, Minn. provides a reservoir that eliminates the need for traditional mixing cups and paint strainers. The PPS™ Paint Preparation System reservoir includes a reusable outer container or cup, an open-topped liner and a lid. The liner is a close fit in the outer container, and paint (or other liquid) that is to be sprayed is contained within the liner. The lid is assembled to the liner and provides a spout or conduit through which the contained paint is conveyed. In use, the liner collapses as paint is withdrawn and, after spraying, the liner and lid can be removed allowing a new, clean liner and lid to be employed for the next use of the spray gun. As a result, the amount of cleaning required is considerably reduced and the spray gun can be readily adapted to apply different paints (or other sprayable coatings) in a simple manner.

Regardless of exact format, the reservoir or pot incorporates one or more connection features that facilitate removable assembly or attachment to the spray gun. In many instances, the spray gun and reservoir are designed in tandem, providing complementary connection formats that promote direct assembly of the reservoir to the spray gun. In other instances, an adaptor is employed between the reservoir and spray gun. The adaptor has a first connection format at one end that is compatible with the spray gun inlet and a second connection format at an opposite end that is compatible with the reservoir outlet. With either approach, releasable connection between the spray gun and reservoir was conventionally achieved via a standard screw thread connection format. Other connection formats have also been suggested, such as a releasable quick-fit connection employing bayonet type formations that are engageable with a push-twist action requiring less than one complete turn of the reservoir to connect/disconnect the reservoir as described, for example, in U.S. Application Publication No. 2013/0221130 the entire teachings of which are incorporated herein by reference. To minimize the possibility of accidental release of the reservoir or diminished fluid-tight seal between the reservoir and spray gun, it has further been suggested to incorporate security clips into the complimentary connection format as described in U.S. Pat. No. 7,083,119, the entire teachings of which are incorporated herein by reference. While these and other connection formats have greatly improved the ease and confidence of removable connection between the reservoir and spray gun, opportunities for improvement remain.

The inventors of the present disclosure recognized that a need exists that overcomes one or more of the above-mentioned problems Some aspects of the present disclosure are directed toward a spray gun reservoir connector system. The system includes a reservoir, a spray gun inlet, a first connector format and a second connector format. The reservoir includes a lid. The first connector format is provided with one of the lid and the spray gun inlet; the second connector format is provided with the other of the lid and the spray gun inlet. The first connector format includes a plurality of retention structures each defining a capture region. The retention structures are collectively arranged in a circular pattern and are circumferentially spaced from one another. The second connector format includes a plurality of lock structures each including a shim body configured to selectively interface with the capture region of a respective one of the retention structures. The lock structures are collectively arranged in a circular pattern and are circumferentially spaced from one another. The connector formats are configured to provide wedged engagement between the lock structures and corresponding ones of the retention structures upon rotation of the spray gun inlet relative to the lid. In some embodiments, the lid further includes a liquid outlet or spout, and the corresponding retention structures or lock structures are radially spaced outside of the spout. In some non-limiting embodiments, the spout may optionally have an inner diameter of not less than 22 mm.

The connector systems of the present disclosure facilitate simple and quick mounting (and removal) of a reservoir to a spray gun (either directly to the spray gun, or to an adaptor that in turn is mounted to the spray gun). The complementary connector formats are aligned then rotated relative to one another to achieve a locked, liquid sealed connection (it being understood that in some embodiments, a liquid seal may also be achieved prior to rotation). The larger diameter spout configurations provided with some embodiments of the present disclosure promote easier cleaning (due to the larger diameter opening and relatively smooth interior of the adaptor chamber).

As used herein, the term "liquid" refers to all forms of flowable material that can be applied to a surface using a spray gun (whether or not they are intended to color the surface) including (without limitation) paints, primers, base coats, lacquers, varnishes and similar paint-like materials as well as other materials, such as adhesives, sealer, fillers, putties, powder coatings, blasting powders, abrasive slurries, mold release agents and foundry dressings which may be applied in atomized or non-atomized form depending on the properties and/or the intended application of the material and the term "liquid" is to be construed accordingly.

The present disclosure includes, but is not limited to, the following exemplary embodiments:

1. A spray gun reservoir connector system comprising:
   a reservoir including a lid;
   a spray gun inlet;
   a first connector format provided with one of the lid and the spray gun inlet, the first connector format including a plurality of retention structures each defining a capture region, wherein the retention structures are collectively arranged in a circular pattern and are circumferentially spaced from one another; and
   a second connector format provided with the other of the lid and the spray gun inlet, the second connector format including a plurality of lock structures each including a shim body configured to selectively interface with the capture region of a respective one of the retention structures, wherein the lock structures are collectively arranged in a circular pattern and are circumferentially spaced from one another;
   wherein the connector formats are configured to provide wedged engagement between the lock structures and corresponding ones of the retention structures upon rotation of the spray gun inlet relative to the lid.

2. The connector system of Embodiment 1, wherein the lid further includes a liquid outlet having a spout, and further wherein the connector format associated with the lid is radially spaced outside of the spout.

3. The connector system of Embodiment 2, wherein the spout has an inner diameter of not less than 22 mm.

4. The connector system of any of Embodiments 1-3, wherein the first connector format is provided with the lid and the second connector format is provided with the spray gun inlet.

5. The connector system of Embodiment 4, wherein the lid further includes a liquid outlet, and further wherein the retention structures are arranged about, and radially spaced from, the liquid outlet.

6. The connector system of any of Embodiments 1-3, wherein the second connector format is provided with the lid and the first connector format is provided with the spray gun inlet.

7. The connector system of Embodiment 6, wherein the lid further includes a liquid outlet, and further wherein the lock structures are arranged about, and radially spaced from, the liquid outlet.

8. The connector system of any of Embodiments 1-7, wherein the spray gun inlet is on an adaptor adapted to connect to a spray gun.

9. The connector system of Embodiment 8, wherein the adaptor further includes a tubular member and a connector feature configured for connection to a spray gun inlet port.

10. The connector system of any of Embodiments 1-7, wherein the spray gun inlet is integral with a spray gun.

11. The connector system of any of Embodiments 1-10, wherein the retention structures each include a contact surface and wedge body defining an engagement surface, and further wherein the engagement surface is longitudinally spaced from the contact surface, and even further wherein the contact surface and the engagement surface combine to define at least a portion of the corresponding capture region.

12. The connector system of Embodiment 11, wherein at least one of the contact surface and the engagement surface defines a plane that is arranged at an angle to a plane perpendicular to an axis of rotation of the system.

13. The connector system of any of Embodiments 1-12, wherein the first connector format further includes a platform defining a contact surface, and further wherein the retention structures project longitudinally away from the contact surface.

14. The connector system of Embodiment 13, wherein the contact surface defines a circle.

15. The connector system of any of Embodiments 13-14, wherein at least a portion of the contact surface is substantially planar.

16. The connector system of any of Embodiments 13-15, wherein platform defines a plurality of undercuts in the contact surface.

17. The connector system of any of Embodiments 1-16, wherein each of the lock structures further includes a stop body extending from the corresponding shim body.

18. The connector system of any of Embodiments 1-17, wherein the shim body of each of the lock structures defines an abutment face opposite a locking face, and further wherein at least one of the abutment face and the locking face defines a plane that is arranged at an angle to a plane perpendicular to an axis of rotation of the system 19. A spray gun reservoir component comprising:
   a liquid outlet comprising a spout;
   a first connector format radially spaced outside of the spout, the first connector format comprising:
      a face revolving around the spout along a rotational direction, the face comprising a first section circumferentially extending in the rotational direction along a first flat segment and a first ramped segment to a second undercut.

20. The spray gun reservoir component of Embodiment 19 wherein the first ramp segment comprises a partial helical shape.

21. The spray gun reservoir component of any of Embodiments 19-20 wherein the first ramped segment tapers longitudinally downward from the first flat segment to the second undercut.

22. The spray gun reservoir component of any of Embodiments 19-21 wherein the first section circumferentially extends from a first undercut to the second undercut.

23. The spray gun reservoir component of Embodiment 22 wherein the face comprises a second section circumferentially extending in the rotational direction from the second undercut to the first undercut.

24. The spray gun reservoir component of Embodiment 23 wherein the second section of the face circumferentially extends in the rotational direction along a second flat segment and a second ramped segment to a first undercut.

25. The spray gun reservoir component of Embodiment 24 wherein the second ramp segment comprises a partial helical shape.

26. The spray gun reservoir component of any of Embodiments 24-25 wherein the second ramped segment tapers longitudinally downward from the second flat segment to the first undercut.

27. The spray gun reservoir component of any of Embodiments 19-26 wherein the second undercut comprises a shoulder.

28. The spray gun reservoir component of any of Embodiments 22-27 wherein the first undercut comprises a shoulder.

29. The spray gun reservoir component of any of Embodiments 19-28 further comprising a first retention structure corresponding to the first section of the face.

30. The spray gun reservoir component of Embodiment 29 wherein the first retention structure is positioned at a transition from the first flat segment to the first ramped segment.
31. The spray gun reservoir component of any of Embodiments 29-30 wherein the first retention structure is located at a circumferential mid-point of the first section.
32. The spray gun reservoir component of any of Embodiments 29-31 wherein the first retention structure is located at a circumferential mid-point between the second undercut and the first undercut.
33. The spray gun reservoir component of any of Embodiments 29-32 wherein the first retention structure defines a first capture region.
34. The spray gun reservoir component of Embodiment 33 wherein the first capture region comprises a vertically downward component in extension between a first end of the first retention structure and a second end of the first retention structure.
35. The spray gun reservoir component of Embodiment 34 wherein the first capture region comprises a segment of a helix revolved about the spout in the rotation direction.
36. The spray gun reservoir component of any of Embodiments 23-35 further comprising a second retention structure corresponding to the second section of the face.
37. The spray gun reservoir component of Embodiment 36 wherein the second retention structure is positioned at a transition from the second flat segment to the second ramped segment.
38. The spray gun reservoir component of any of Embodiments 36-37 wherein the second retention structure is located at a circumferential mid-point of the second section.
39. The spray gun reservoir component of any of Embodiments 36-38 wherein the second retention structure is located at a circumferential mid-point between the first undercut and the second undercut.
40. The spray gun reservoir component of any of Embodiments 36-39 wherein the second retention structure defines a second capture region.
41. The spray gun reservoir component of Embodiment 40 wherein the second capture region comprises a vertically downward component in extension between a first end of the second retention structure and a second end of the second retention structure.
42. The spray gun reservoir component of Embodiment 41 wherein the second capture region comprises a segment of a helix revolved about the spout in the rotation direction.
43. The spray gun reservoir component of any of Embodiments 19-42 wherein the first connector format comprises a platform, wherein the platform comprises the face.
44. The spray gun reservoir component of any of Embodiments 19-43, wherein the spout has an inner diameter of not less than 22 mm.
45. The spray gun reservoir component of any of Embodiments 36-44, wherein the first and second retention structures are arranged about, and radially spaced from, the spout.
46. The spray gun reservoir component of any of Embodiments 36-45, wherein the first and second retention structures each include a contact surface and wedge body defining an engagement surface, and further wherein the engagement surface is longitudinally spaced from the contact surface, and the contact surface and the engagement surface combine to define at least a portion of the corresponding capture region.
47. The spray gun reservoir component of Embodiment 46 wherein at least one of the contact surface and the engagement surface defines a plane that is arranged at an angle to a plane perpendicular to an axis of rotation of the system.
48. The spray gun reservoir component of any of Embodiments 43-47, wherein the platform defines a contact surface, and further wherein the first and second retention structures project longitudinally away from the contact surface.
49. The spray gun reservoir component of Embodiment 48, wherein the contact surface defines a circle.
50. The spray gun reservoir component of any of Embodiments 48-49, wherein at least a portion of the contact surface is substantially planar.
51. The spray gun reservoir component of any of Embodiments 19-50, wherein the spray gun reservoir component is a lid for a spray gun reservoir.
52. The spray gun reservoir component of any of Embodiments 19-51, wherein the spray gun reservoir component is a pot.

BRIEF DESCRIPTION OF THE DRAWINGS

FIG. 5C is a front view of the adaptor of FIG. 5A;

FIG. 5D is a side view of the adaptor of FIG. 5A;

DETAILED DESCRIPTION

Figure 1:
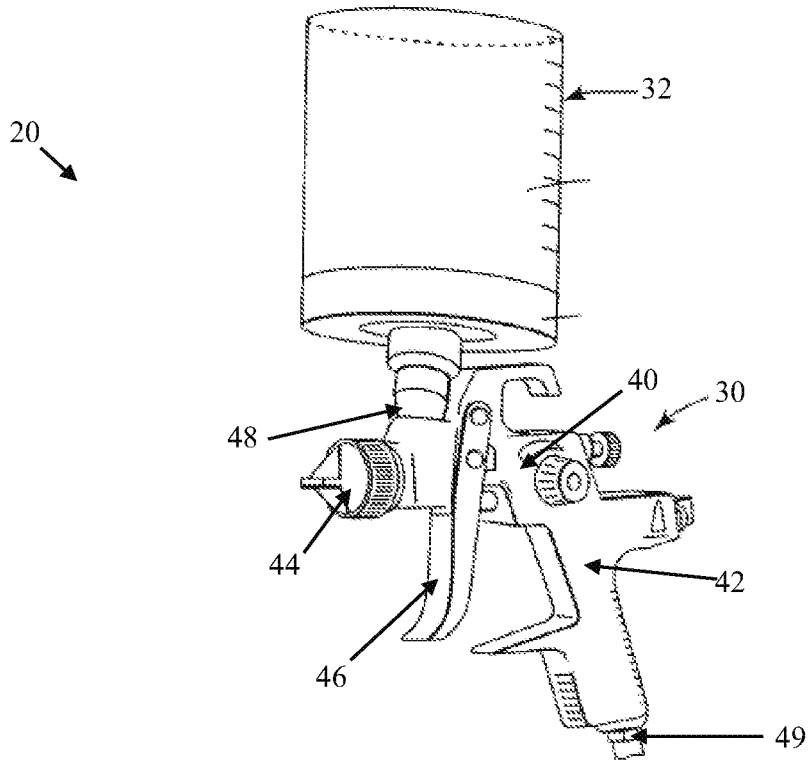
FIG. 1 is a simplified perspective view of a spray gun assembly including a spray gun and a reservoir.

Aspects of the present disclosure are directed toward connection systems that facilitate releasable, sealed connection between a spray gun and reservoir. By way of background, FIG. 1 depicts a spray gun paint system 20 including a spray gun 30 of a gravity-feed type and a reservoir 32. The gun 30 includes a body 40, a handle 42, and a spray nozzle 44 at a front end of the body 40. The gun 30 is manually operated by a trigger 46 that is pivotally mounted on the sides of the body 40. An inlet port 48 (referenced generally) is formed in or carried by the body 40, and is configured to establish a fluid connection between an interior spray conduit (hidden) of the spray gun 30 and the reservoir 32. The reservoir 32 contains liquid (e.g., paint) to be sprayed, and is connected to the inlet port 48 (it being understood that the connection implicated by the drawing of FIG. 1 does not necessarily reflect the connections of the present disclosure). In use, the spray gun 30 is connected via a connector 49 at a lower end of the handle 42 to a source of compressed air (not shown). Compressed air is delivered through the gun 30 when the user pulls on the trigger 46 and paint is delivered under gravity from the reservoir 32 through the spray gun 30 to the nozzle 44. As a result, the paint (or other liquid) is atomized on leaving the nozzle 44 to form a spray with the compressed air leaving the nozzle 44.

Figure 2:
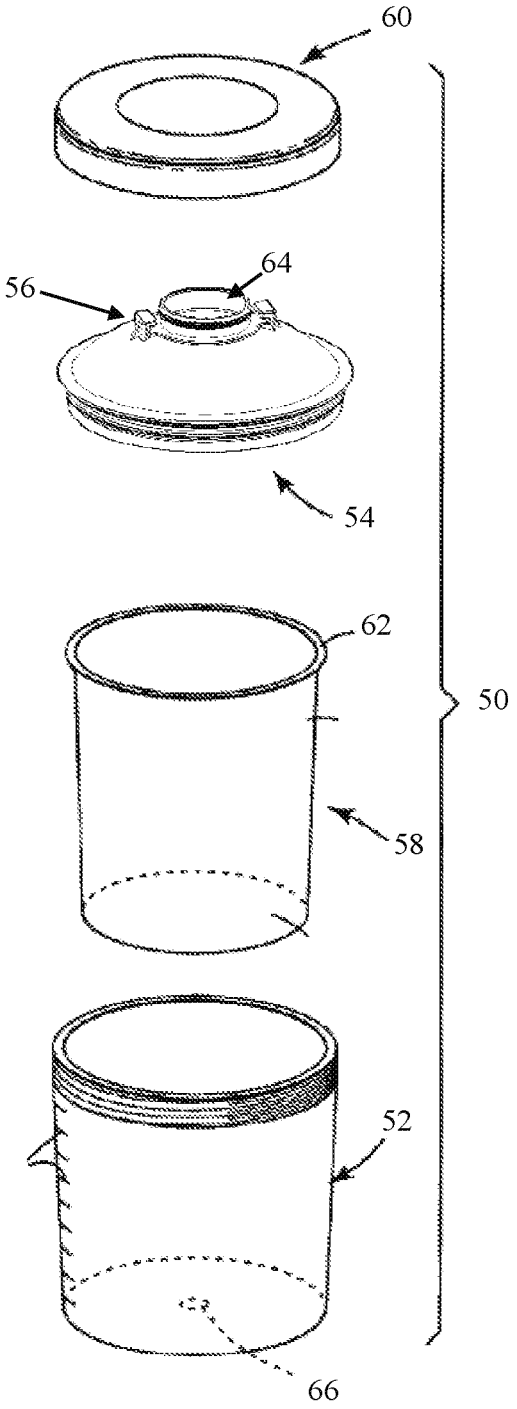
FIG. 2 is an exploded view of a reservoir incorporating a connection format in accordance with principles of the present disclosure.

For ease of illustration, connection formats of the present disclosure between the spray gun 30 and the reservoir 32 are not included with the drawing of FIG. 1. In general terms, the reservoir 32 includes one or more components establishing a first connection format for connection to the spray gun 30. A complementary, second connection format is included with an adaptor (not shown) assembled between the reservoir 32 and the inlet port 48, or with the spray gun 30. With this background in mind, FIG. 2 illustrates one non-limiting example of a reservoir 50 in accordance with principles of the present disclosure. The reservoir 50 includes an outer container 52 and a lid 54. The lid 54 includes or provides a first connection format or feature 56 (referenced generally) described in greater detail below. Remaining components of the reservoir 50 can assume various forms and are optional. For example, in some embodiments the reservoir 50 further includes a liner 58 and a collar 60. In general terms, the liner 58 corresponds in shape to (and is a close fit in) the interior of the container 52 and can have a narrow rim 62 at the open end which sits on the top edge of the container 52. The lid 54 is configured to push-fit in the open end of the liner 58 to locate the peripheral edge of the lid 54 over the rim 62 of the liner 58. The lid/liner assembly is secured in place by the annular collar 60 that releasably engages the container 52 (e.g., threaded interface as shown, snap fit, etc.).

In addition to the connection format 56, the lid 54 forms a liquid outlet 64 (referenced generally) through which liquid contained by the liner 58 can flow. In use, the liner 58 collapses in an axial direction toward the lid 54 as paint is withdrawn from the reservoir 50. An optional vent hole 66 in the base of the outer container 52 allows air to enter as the liner 58 collapses. On completion of spraying, the reservoir 50 can be detached from the spray gun 30 (FIG. 1), the collar 60 released and the lid/liner assembly removed from the outer container 52 in one piece. The outer container 52 and the collar 60 are left clean and ready for re-use with a fresh liner 58 and lid 54. In this way, excessive cleaning of the reservoir 50 can be avoided.

In other embodiments, the reservoirs of the present disclosure need not include the liner 58 and/or the collar 60. The connection formats of the present disclosure can be implemented with a plethora of other reservoir configurations that may or may not be directly implicated by the figures.

Figure 3:
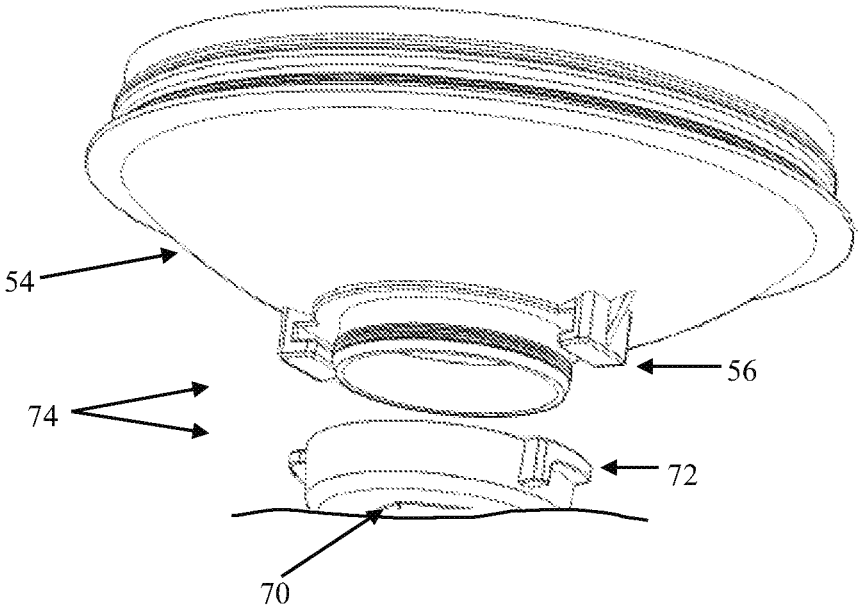
FIG. 3 is a perspective view of a portion of a spray gun reservoir connector system in accordance with principles of the present disclosure and including complimentary connection formats.

As mentioned above, the first connection format 56 provided with the lid 54 is configured to releasably connect with a complementary second connection format provided with a spray gun inlet or apparatus. As point of reference, FIG. 3 illustrates the lid 54 along with a portion of a spray gun inlet 70 that otherwise carries or provides a second complementary connection format 72 (referenced generally). The spray gun inlet 70 can be an adaptor, an integral portion of the spray gun 30 (FIG. 1), etc. Regardless, the first and second connection formats 56, 72 are configured in tandem, promoting a releasable, liquid-tight sealed mounting or connection between the lid 54 and the spray gun inlet 70. In some embodiments, the first and second complementary connection formats 56, 72 can be viewed as collectively defining a spray gun reservoir connector system 74 in accordance with principles of the present disclosure.

The first connection format 56 is now described with reference to FIGS. 4A-4D that otherwise illustrate the lid 54 in isolation. A shape of the lid 54 can be viewed as defining a longitudinal axis A. In addition to the first connection format 56 and the fluid outlet 64, the lid 54 includes or defines a wall 80, a flange 82, and a hub 84. The wall 80 defines opposing, inner and outer faces 86, 88, with at least the outer face 88 of the wall 80 having, for example (but not limited to) the curved (e.g., hemispherical) shape implicated by the drawings. Finally, the wall 80 defines a central opening 90 (best seen in FIG. 4D) that is co-axial with the longitudinal axis A. The flange 82 projects radially outwardly from a perimeter of the wall 80 opposite the central opening 90, and is configured to interface with one or more other components of the reservoir 50 (FIG. 2), for example the outer container 52 (FIG. 2). The hub 84 projects longitudinally (relative to the longitudinal axis A) from the flange 82 in a direction opposite the wall 80, and can is configured to interface with one or more other components of the reservoir 50, for example the liner 58 (FIG. 2). The wall 80, flange 82, and the hub 84 can assume a wide variety of other forms. Further, in other embodiments, one or both of the flange 82 and the hub 84 can be omitted.

The liquid outlet 64 includes a spout 100. The spout 100 is co-axial with the longitudinal axis A, projecting upwardly (relative to the orientation of FIG. 4A) from the wall 80 and terminating at a leading surface 102. The spout 100 defines a passage 104 (best seen in FIG. 4D) that is aligned with, and open to, the central opening 90. With this construction, liquid flow through the fluid outlet 64 (e.g., from a location within the confines of the inner face 86 of the wall 80 to a location external the spout 100) readily occurs through the central opening 90 and the passage 104.

In some embodiments, the fluid outlet 64 includes one or more additional features that can optionally be considered components of the first connection format 56. For example, the leading surface 102 can be configured to form a face seal with the complementary component or device (e.g., the spray gun inlet 70 of FIG. 3) upon assembly to the lid 54. The sealing relationship can be established by the leading surface 102 being substantially flat or planar (i.e., within 5% of a truly flat or planar shape) in a plane perpendicular to the longitudinal axis A. Further, one or more annular ribs 106 can be formed along an exterior of the spout 100 proximate the leading surface 102 and configured to form an annular seal with the spray gun inlet 70 upon assembly to the lid 54. Liquid tight seal(s) between the lid 54 and the spray gun inlet 70 can alternatively be promoted with a variety of other constructions that may or may not include one or both of the leading surface 102 and the annular rib(s) 106.

The first connection format 56 includes a platform 110 and a plurality of retention structures 112. The platform 110 and retention structures 112 project from the outer face 88 of the wall 80 at a location external the spout 100, and are configured to facilitate selective connection or mounting with the second complementary connection format 72 (FIG. 3) as described below.

The platform 110 extends from the outer face 88 and terminates at a contact surface 120. The contact surface 120 is configured to provide a sliding interface with the spray gun inlet (not shown), and can have a shape differing from the optional curved shape of the wall 80. In some embodiments, the contact surface 120 is substantially flat or planar (i.e., within 5% of a truly flat or planar shape) in a plane perpendicular to the longitudinal axis A. The contact surface 120 circumferentially surrounds the spout 100, and is sized and shaped to correspond with locations of the retention structures 112. For example, and as best reflected by FIG. 4A, the contact surface 120 can have an enlarged radial width in a region of each of the retention structures 112. In other embodiments, the contact surface 120 can have a more uniform radial width.

In some embodiments, the retention structures 112 can be identical. Each of the retention structures 112 defines opposing, first and second ends 124, 126, and includes a support body 130 and a wedge body 132. The support body 130 is radially spaced from the spout 100, and projects upwardly from the wall 80. One or more reinforcement ribs 133 are optionally provided between the support body 130 and the wall 80, serving to minimize deflection of the support body 130 away from the spout 100 during use. The wedge body 132 projects radially inwardly from the support body 130 opposite the wall 80. A capture region 134 is defined by the contact surface 120, the support body 130 and the wedge body 132 for receiving a corresponding feature of the spray gun inlet 70 (FIG. 3).

Figure 4A:
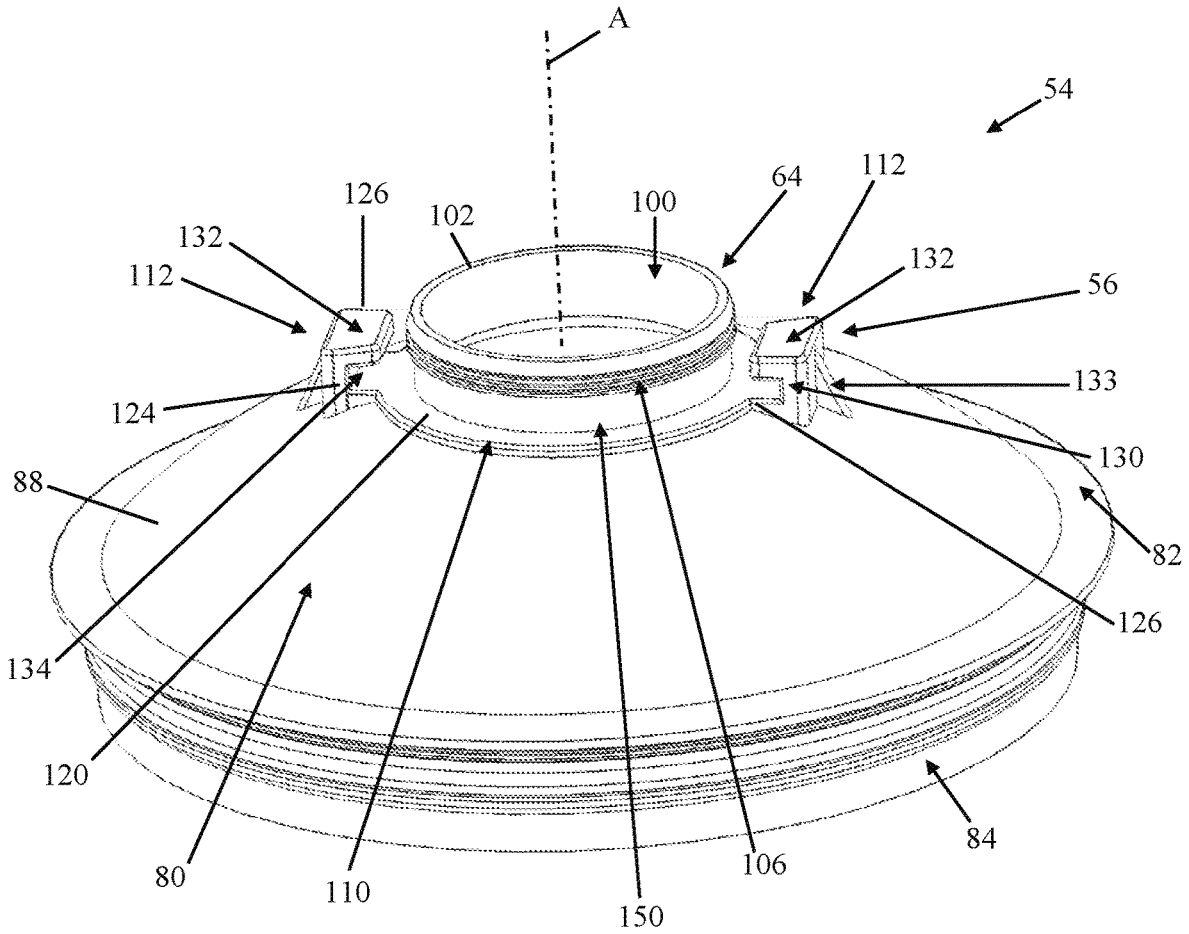
FIG. 4A is a perspective view of a lid portion of the reservoir of FIG. 3.
Figure 4B:
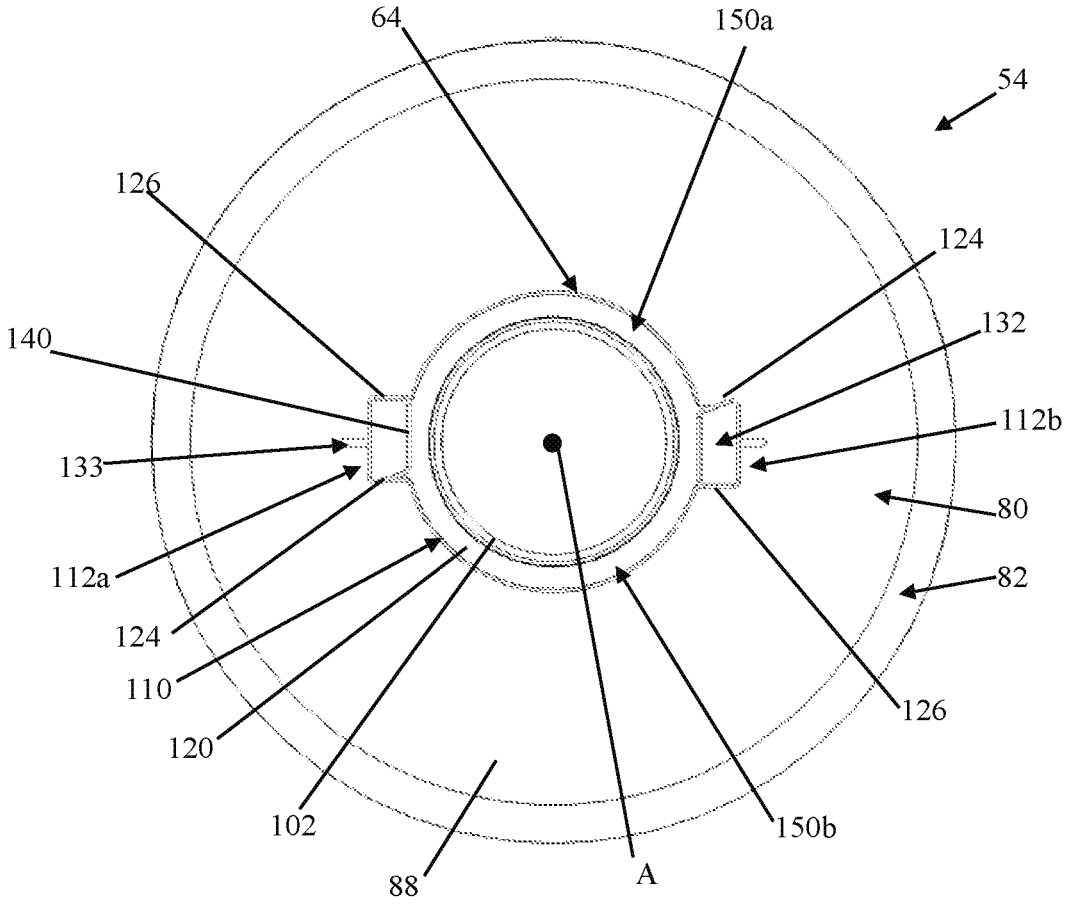
FIG. 4B is a top view of the lid of FIG. 4A.
Figure 4C:
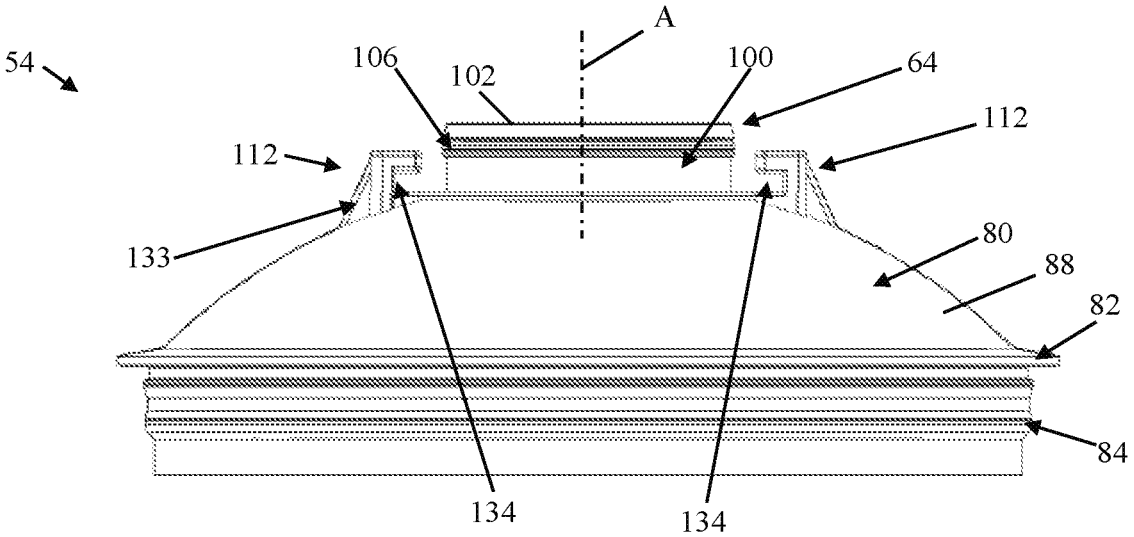
FIG. 4C is a side view of the lid of FIG. 4A.
Figure 4D:
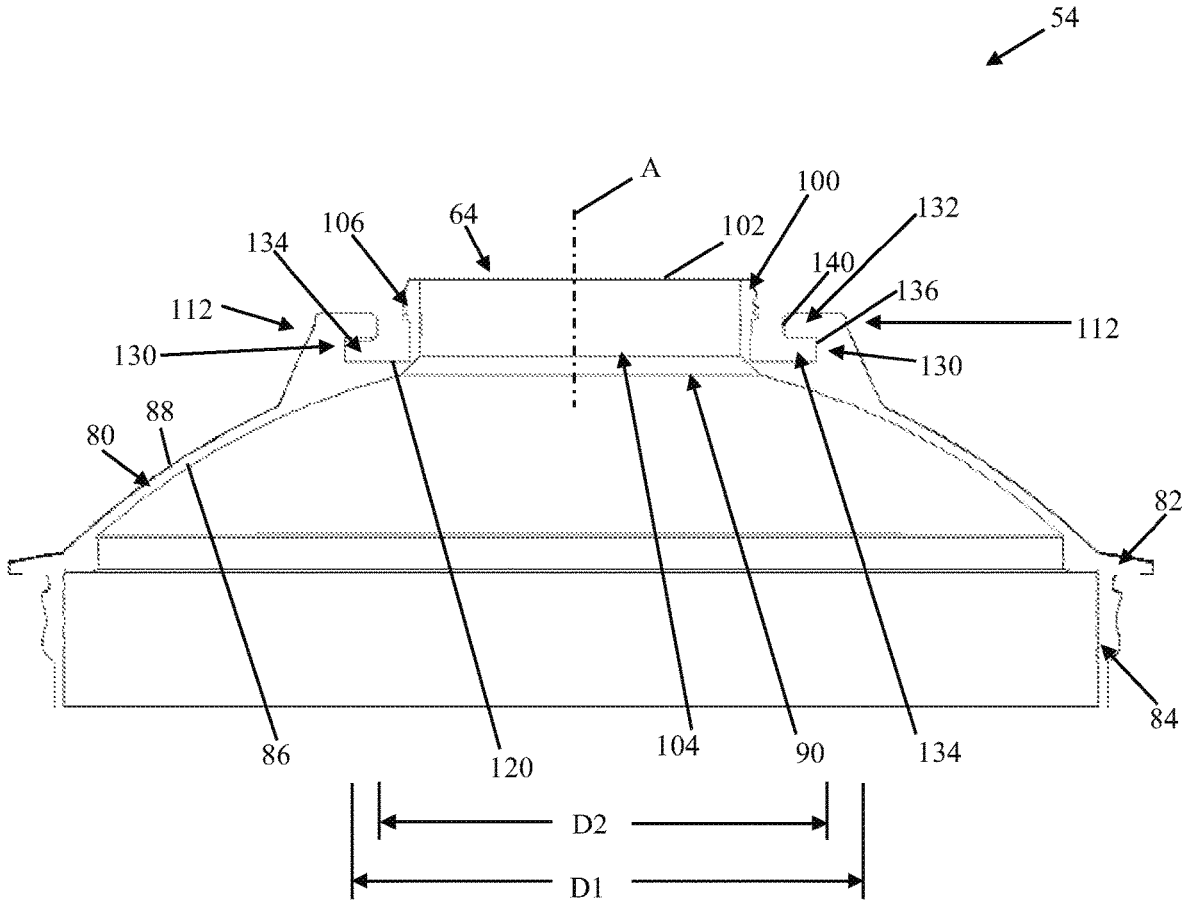
FIG. 4D is a longitudinal cross-sectional view of the lid of FIG. 4A.
Figure 4E:
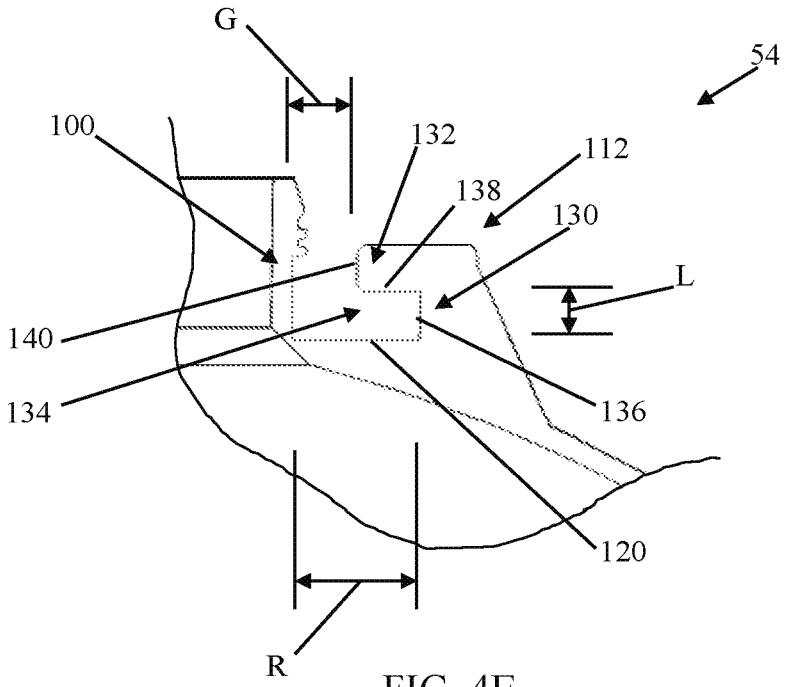
FIG. 4E is an enlarged cross-sectional view of a portion of the lid of FIG. 4A.

More particularly, and as best shown in FIG. 4E, projection of the support body 130 defines a guide surface 136. The guide surface 136 faces the spout 100, and is radially spaced from an exterior of the spout 100 by a radial spacing R. The wedge body 132 projects radially inwardly relative to the guide surface 136 and defines an engagement surface 138 and an alignment surface 140. The engagement surface 138 faces the contact surface 120, and is longitudinally spaced from the contact surface 120 by a longitudinal spacing L. The contact surface 120, the guide surface 136 and the engagement surface 138 combine to define the capture region 134. The alignment surface 140 faces the spout 100, and is radially spaced from an exterior of the spout 100 by a radial gap G. Dimensions of the radial spacing R and of the radial gap G correspond with geometry features of the spray gun inlet 70 (FIG. 3). In this regard, and with additional reference to FIG. 4D, the guide surfaces 136 collectively define, relative to the longitudinal axis A, a capture diameter D1; the alignment surfaces 140 collectively define a clearance diameter D2. The capture and clearance diameters D1, D2 are selected in accordance with geometry features of the spray gun inlet 70 (and vice-versa) to facilitate desired coupling and uncoupling operations as described below.

Figure 4F:
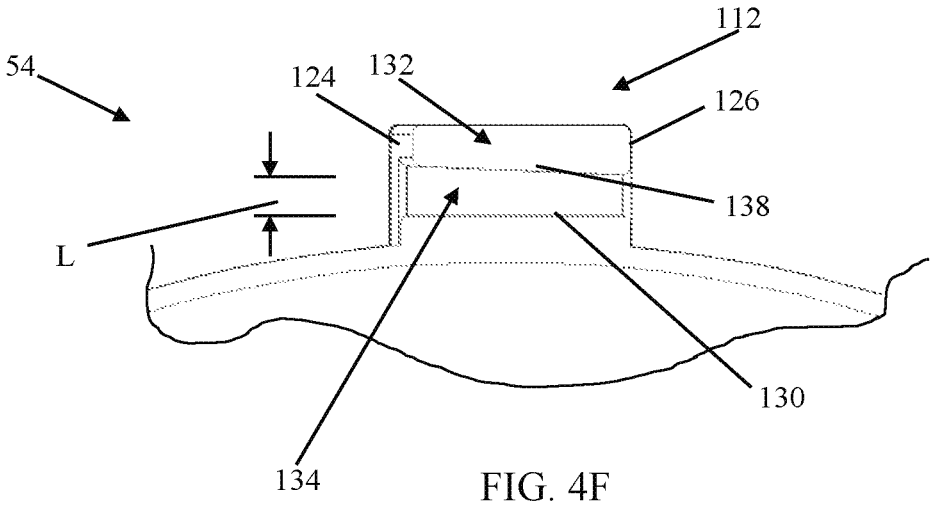
FIG. 4F is an enlarged cross-sectional view of the portion of FIG. 4E from a different cross-sectional plane.

Geometry of the contact surface 120 and the engagement surface 138 is configured to facilitate a wedge-like engagement of corresponding features of the complementary second connection format 72 (FIG. 3) within the capture region 134. With reference to FIG. 4F, the engagement surface 138 is substantially flat (i.e., within 5% of a truly flat shape), and a plane of the engagement surface 138 is non-parallel relative to a plane of the contact surface 120. For example, planes of the contact and engagement surfaces 120, 138 combine to define an included angle on the order of 1-70 degrees, for example in the range of 1-30 degrees. With this construction, the longitudinal spacing L tapers from the first end 124 to the second end 126. Due to this tapering or wedge-like shape, a rigid body (provided with the second connection format 72) initially inserted into the capture region 134 at the first end 124 and then directed toward the second end 126 will become frictionally wedged or engaged within the capture region 134 as described below. With additional reference to FIG. 4B, the retention structures 112 are arranged such that the tapering shape of the capture region 134 of each retention structure 112 is in the same rotational direction relative to the longitudinal axis A. For example, relative to the orientation of FIG. 4B, the capture region 134 (hidden in FIG. 4B) of each of the retention structures 112 tapers in the clockwise direction (e.g., the first end 124 is rotationally "ahead" of the corresponding second end 126 in the clockwise direction). FIG. 4B further reflects that the leading end 124 can define a recess to further promote initial directing of a body into the capture region 134. The alignment surface 140 of each retention structure 112 can be substantially planar as shown, generally tangent to a circumference of the spout 100; in other embodiments, the alignment surface 140 can have an arcuate shape, generally following a curvature of the spout 100.

Returning to FIGS. 4A-4D, the retention structures 112 establish robust engagement or connection with the complementary second connection format 72 (FIG. 3), and are apart from the spout 100. With this construction, and unlike prior fluid connector designs utilized with paint spray guns, the connection formats of the present disclosure permit the spout 100, and thus the fluid outlet 64, to present a relatively large inner diameter. In some embodiments, an inner diameter of the spout 100 is not less than 20 mm, alternatively not less than 22 mm, and optionally on the order of 30 mm. Further, by locating the capture region 134 in close proximity to the wall 80, a height of the spout 100 can be reduced as compared to conventional spray gun reservoir connector designs. In some non-limiting embodiments, for example, a height of the spout 100 is on the order of 5-15 mm.

While FIGS. 4A-4D illustrate the first connection format 56 as including two of the retention structures 112, in other embodiments three or more of the retention structures 112 are provided. The retention structures 112 are optionally equidistantly spaced about the spout 100 in some embodiments. Regardless, an open zone 150 is defined between circumferentially adjacent ones of the retention structures 112. For example, FIG. 4B identifies a first open zone 150*a* circumferentially between the second end 126 of the first retention structure 112*a* and the first end 124 of the second retention structure 112*b*, and a second open zone 150*b* circumferentially between the second end 126 of the second retention structure 112*b* and the first end 124 of the first retention structure 112*a*.

Returning to FIG. 3, the second connection format 72 is configured to selectively mate with features of the first connection format 56. In some embodiments, the second connection format 72 is provided as part of an adaptor, such as an adaptor 180 shown in FIGS. 5A-5E. In addition to the second connection format 72 (referenced generally in FIG. 5A), the adaptor 180 includes a tubular member 190. Details on the various components are provided below. In general terms, a shape of the adaptor 180 defines a central axis X. The tubular member 190 can include or provide features akin to conventional spray gun reservoir connection adaptors, such as for establishing connection to an inlet port of the spray gun. A base 192 of the second connection format 72 projects from the tubular member 190 and carries or defines other portions of the second connection format 72, and promotes mounting of the adaptor 180 to the lid 54 (FIG. 3).

Figure 5A:
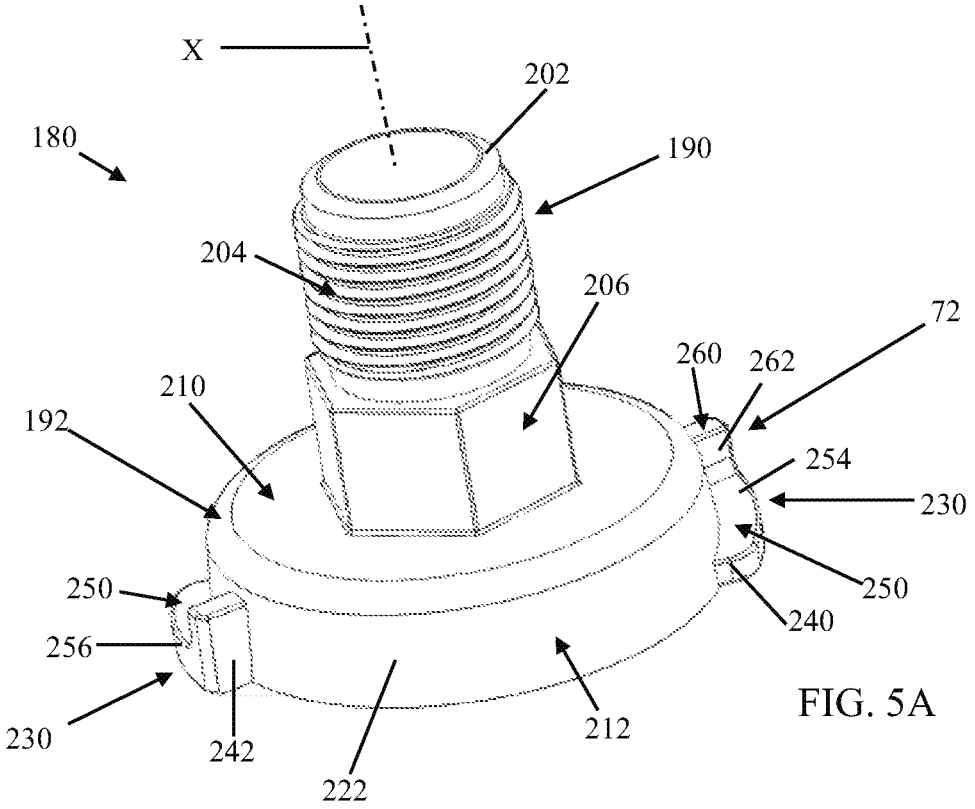
FIG. 5A is a perspective view of an adaptor useful with the connector systems of the present disclosure and including a connection format complementary with the connection format of the lid of FIG. 4A.
Figure 5B:
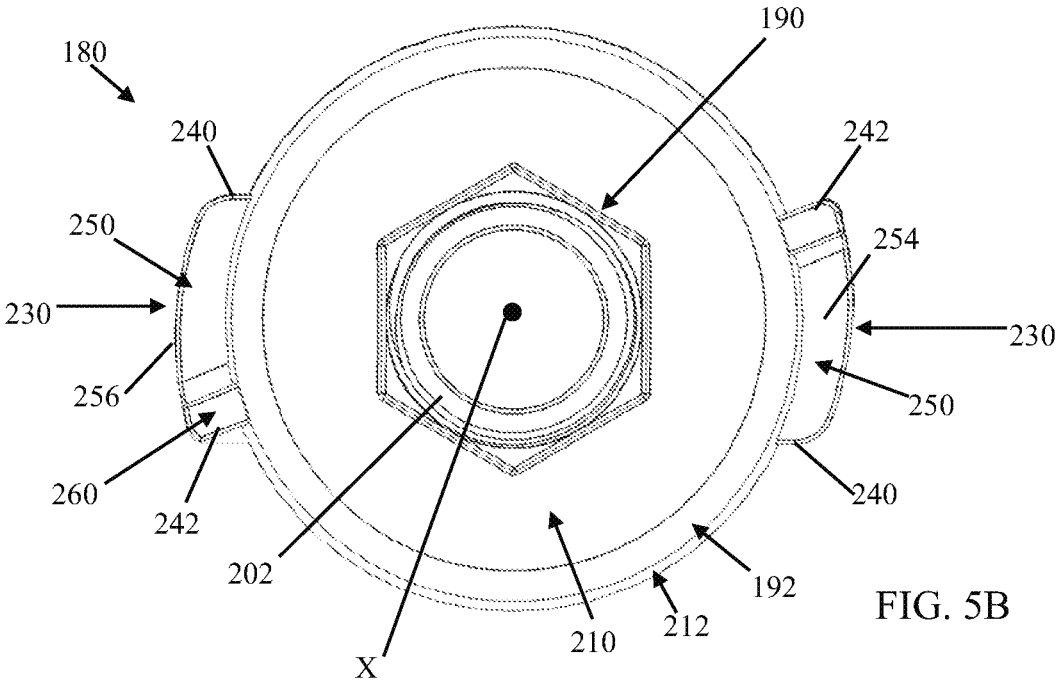
FIG. 5B is a top view of the adaptor of FIG. 5A.
Figure 5E:
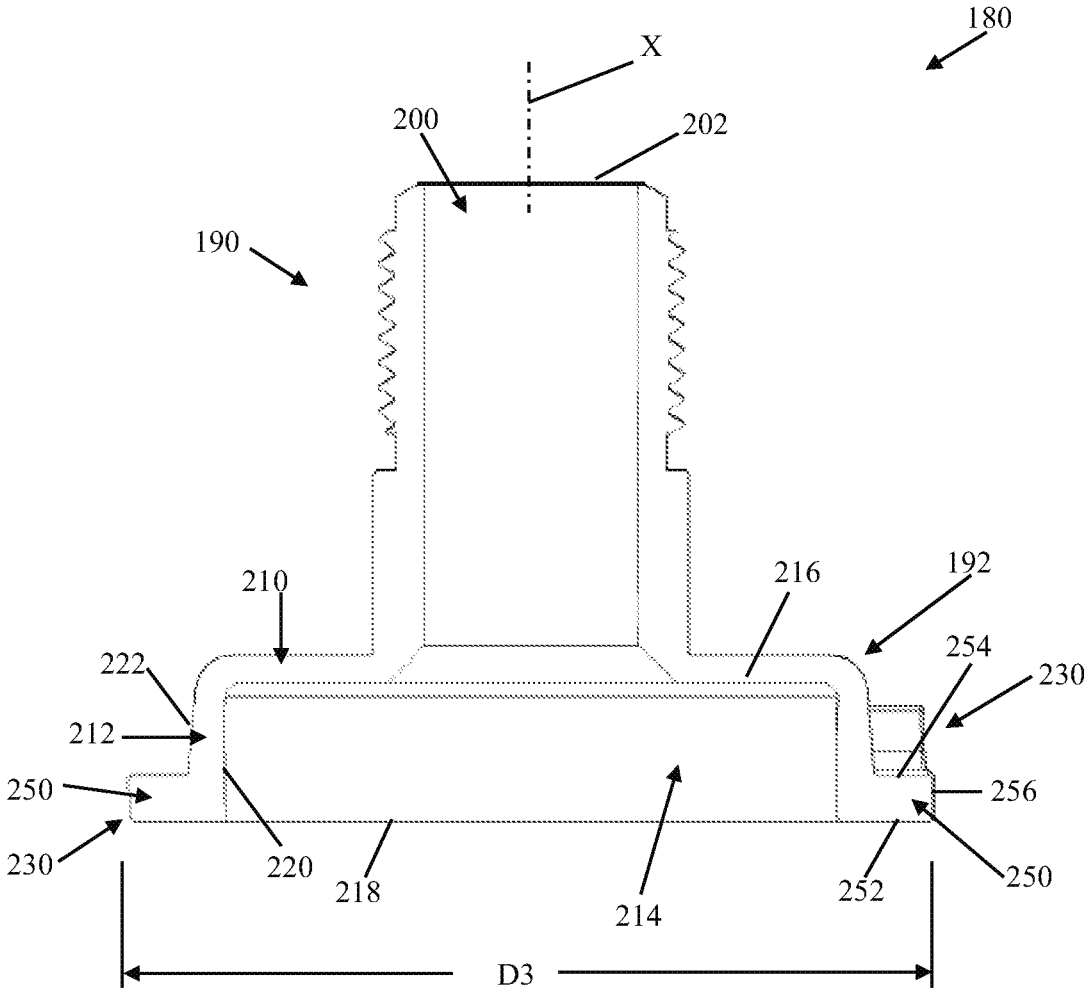
FIG. 5E is a longitudinal cross-sectional view of the adaptor of FIG. 5A.

The tubular member 190 can assume various forms, and defines a central passageway 200 (best shown in FIG. 5E). The passageway 200 is open at a leading end 202 of the tubular member 190. The tubular member 190 forms or provides mounting features that facilitate assembly to a conventional (e.g., threaded) spray gun inlet port. For example, exterior threads 204 can be provided along the tubular member 190 adjacent the leading end 202, configured to threadably interface with threads provided by the spray gun inlet port. In this regard, a pitch, profile and spacing of the exterior threads 204 can be selected in accordance with the specific thread pattern in the make/model of the spray gun with which the adaptor 180 is intended for use. Other spray gun mounting features are equally acceptable that may or may not include or require the exterior threads 202. The tubular member 190 can optionally further include or define a grasping section 206. The grasping section 206 is configured to facilitate user manipulation of the adaptor 180 with a conventional tool, and in some embodiments includes or defines a hexagonal surface pattern adapted to be readily engaged by a wrench. In other embodiments, the grasping section 206 can be omitted.

The base 192 extends from the tubular member 190 opposite the leading end 202, and includes a shoulder 210 and a ring 212. As best shown in FIG. 5E, the shoulder 210 and the ring 212 combine to define a chamber 214 that is open to the central passageway 200 of the tubular member 190 and that is configured to receive the spout 100 (FIG. 4A) of the lid 54 (FIG. 4A). The shoulder 210 extends radially outwardly from the tubular member 190 (relative to the central axis X), and defines an interior radial face 216. In some embodiments, the interior radial face 216 is substantially flat or planar (i.e., within 5% of a truly flat or planar shape) in a plane perpendicular to the central axis X for reasons made clear below. The ring 212 projects longitudinally from an outer perimeter of the shoulder 210 in a direction opposite the tubular member 190 and terminates at a contact face 218. Further, the ring 212 defines a cylindrical inner face 220 and a cylindrical outer face 222. An inner diameter of the ring 212 (e.g., a diameter defined by the cylindrical inner face 220 corresponds with (e.g., approximates or is slightly greater than) an outer diameter of the spout 100. An outer diameter of the ring 212 can expand in extension to the contact face 218 or can be uniform. Regardless, a maximum outer diameter of the ring 212 (e.g., a maximum diameter defined by the cylindrical outer face 222) corresponds with (e.g., approximates or is slightly less than) the clearance diameter D1 (FIG. 4D) described above. In some embodiments, the contact face 218 is substantially flat or planar (i.e., within 5% of a truly flat or planar shape) in a plane perpendicular to the central axis X for reasons made clear below.

In some embodiments, the interior radial face 216 and/or the cylindrical inner face 220 establish a liquid-tight seal with the lid 54 (FIG. 4A) upon final assembly, and thus can be considered to be components of the second connection format 72 in accordance with principles of the present disclosure. In other embodiments, the interior radial face 216, the cylindrical inner face 220 and/or other components of the base 192 can be considered separate from the second connection format 72. Regardless, the second connection format 72 includes a plurality of lock structures 230. The lock structures 230 project outwardly from the cylindrical outer face 222 and are sized and shaped to selectively engage with corresponding ones of the retention structures 112 (FIG. 4A) as described below.

In some embodiments, the lock structures 230 are identical, and each defines a first end 240 opposite a second end 242 in circumferential extension along the ring 212. The lock structure 230 includes a shim or wedge body 250 defining an abutment face 252, a locking face 254, and a guide face 256. The abutment face 252 projects from the ring 212 at or immediately adjacent the contact face 218. In some embodiments, the abutment face 252 is substantially flat or planar (i.e., within 5% of a truly flat or planar shape) in a plane perpendicular to the central axis X and is flush with the contact face 218 (e.g., the contact face 218 and the abutment face 252 can be co-planar).

The locking face 254 is formed longitudinally opposite the abutment face 252 to define a height $H_S$ of the shim body 250 as identified in FIG. 5D. Further, the locking face 254 generates a shape or geometry relative to the ring 212 akin to a segment of a helix. As best shown in FIG. 5D, the abutment face 252 is substantially flat (i.e., within 5% of a truly flat shape), and a plane of the locking face 254 is non-parallel relative to a plane of the abutment face 252. For example, planes of the abutment and locking faces 252, 254 combine to define an included angle on the order of 1-70 degrees, for example in the range of 1-30 degrees. In some embodiments, the included angle defined by the abutment and locking faces 252, 254 slightly differs from the included angle defined by the retention structures 112 as previously described with respect to FIG. 4F to optionally create an interference between the two components during use. With this construction, the height $H_S$ of the shim body 250 increases from the first end 240 toward the second end 242, and is selected in accordance with the longitudinal spacing L (FIG. 4F) of the retention structures 112 as made clear below. In general terms, due to this expanding height or wedge-like shape and corresponding dimensions, the shim body 250 will become frictionally wedged or engaged within a corresponding one of the retention structures 112. In some embodiments, interference is created by interaction of the locking faces and retention structures such that the components "bite" into one another to provide increased friction and retention. In such cases, the included angles noted above may be deliberately mismatched. With continued reference to FIGS. 5A-5E, the lock structures 230 are arranged about the ring 212 such that the expanding shape of the shim body 250 of each lock structure 230 is in the same rotational direction relative to the central axis X. For example, relative to the orientation of FIG. 5B, the shim body 250 of each of the lock structures 230 expands in the clockwise direction (e.g., the first end 240 is rotationally "ahead" of the corresponding second end 242 in the clockwise direction). FIG. 5B further reflects that the first end 240 can define a curved edge 258 to further promote initial directing of the shim body 250 into one of the retention structures 112.

The guide face 256 of each lock structure 230 is defined opposite the ring 212 and in some embodiments mimics a curvature of the cylindrical outer face 222. Other shapes are also acceptable that may or not be curved. Regardless, and as identified in FIG. 5E, the guide faces 256 collectively define, relative to the central axis X, a maximum outer diameter D3. With additional reference to FIG. 4D, the maximum outer diameter D3 is designed in accordance with dimensions of the first connection format 56, and in particular to be slightly less than the capture diameter D1 and greater than the clearance diameter D2 for reasons made clear below.

In some embodiments, each of the lock structures 230 can further include a stop body 260. The stop body 260 is located at the second end 242 of the corresponding lock structure 230, and projects longitudinally from, or relative to, the locking face 254 of the corresponding shim body 250 in a direction opposite the abutment face 252. In this regard, the stop body 260 defines a stop face 262 projecting beyond the height $H_S$ of the shim body 250. As identified in FIG. 5D, a height $H_B$ of the stop body 260 is selected to be greater than the longitudinal spacing L (FIG. 4F) of the retention structures 112 (FIG. 4F) for reasons made clear below. In other embodiments, the stop body 260 can be omitted.

While FIGS. 5A-5E illustrate the second connection format 72 as including two of the lock structures 230, in other embodiments three or more of the lock structures 230 are provided, with the number of lock structures 230 optionally matching the number of retention structures 112 (FIG. 4A) provided with the complementary first connection format 56 (FIG. 4A). Similarly, a spacing between circumferentially adjacent ones of the lock structures 230 mimics the circumferential spacing between the retention structures 112 (e.g., the lock structures 230 are optionally equidistantly spaced about the ring 212 100 in some embodiments). Regardless, circumferential length (e.g., arc length) of each of the lock structures 240 is less than a circumferential length of each of the open zones 150 (FIG. 4B) of the first connection format 56.

Figure 6:
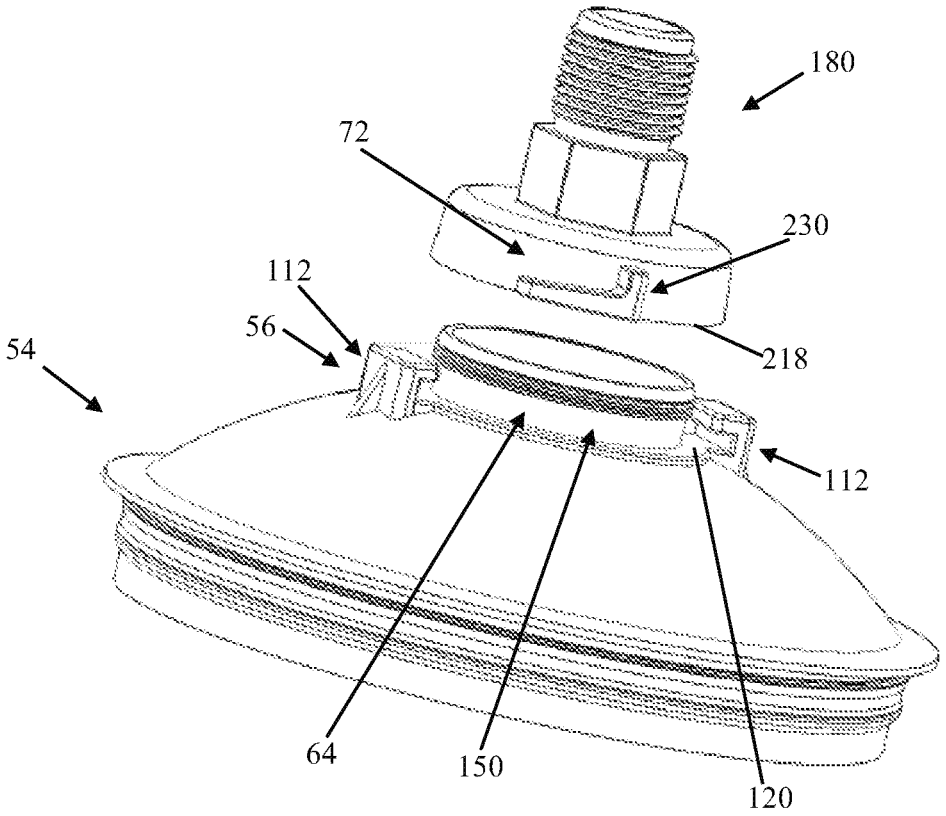
FIGS. 6-9C illustrate assembly of the connector system of FIG. 3, including coupling the lid of FIG. 4A with the adaptor of FIG. 5A.
Figure 7A:
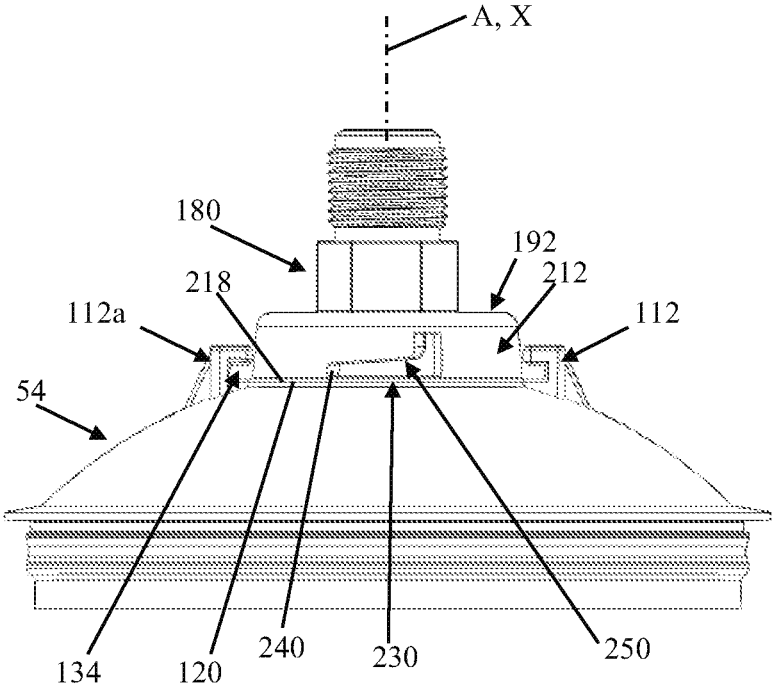
Figure 7B:
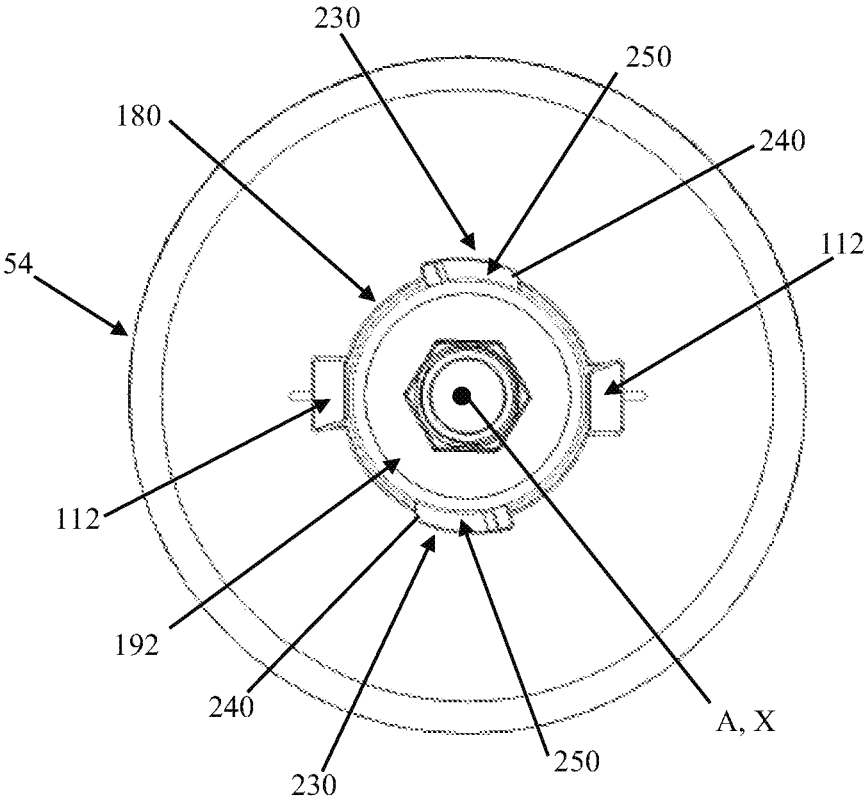

With reference to FIG. 6, engagement between the first and second connection formats 56, 72 (and thus between the lid 54 and the adaptor 180) initially entails aligning the adaptor 180 with the fluid outlet 64. The lid 54 and adaptor 180 are spatially arranged such that the contact face 218 of the adaptor 180 faces the contact surface 120 of the lid 54, and the lock structures 230 are rotationally off-set from the retention structures 112 (i.e., the lock structures 230 are each longitudinally aligned with a respective one of the open zones 150). The lid 54 and adaptor 180 are then directed toward one another, bringing the contact face 218 of the adaptor 180 into contact with contact surface 120 of the lid 54 as shown in FIGS. 7A and 7B. The base 192 is located over the spout 100 (hidden in FIGS. 7A and 7B, but shown, for example, in FIG. 6), and the central axis X of the adaptor 180 is aligned with the longitudinal axis A of the lid 54. Commensurate with the descriptions above, the outer diameter of the ring 212 of the base 192 is less than the clearance diameter D2 (FIG. 4D) collectively generated by the retention structures 112, allowing the base 192 to nest over the spout 100 "inside" of the retention structures 112. In the initial state of FIGS. 7A and 7B, the lock structures 230 are rotationally spaced from the retention structures 112. However, due to corresponding geometries of the lid 54 and the adaptor 180, engagement between the contact surface 120 and the contact face 218 circumferentially aligns the lock structures 230 with the retention structures 112 (e.g., FIG. 7A illustrates the first end 240 of the lock structure 230 being circumferentially aligned with the capture region 134 of the first retention structure 112*a*).

Figure 8A:
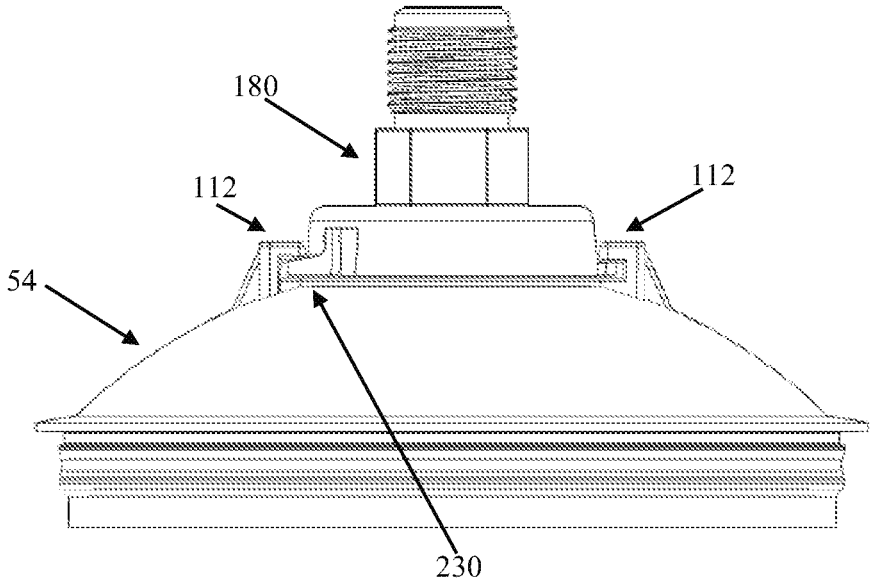
Figure 8B:
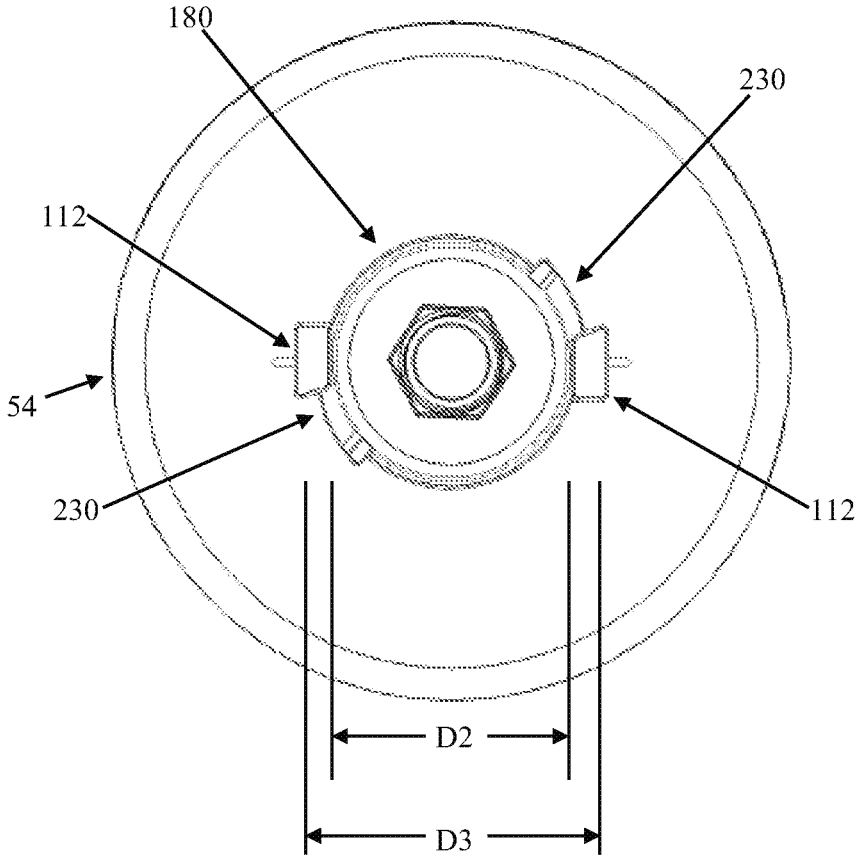
Figure 8C:
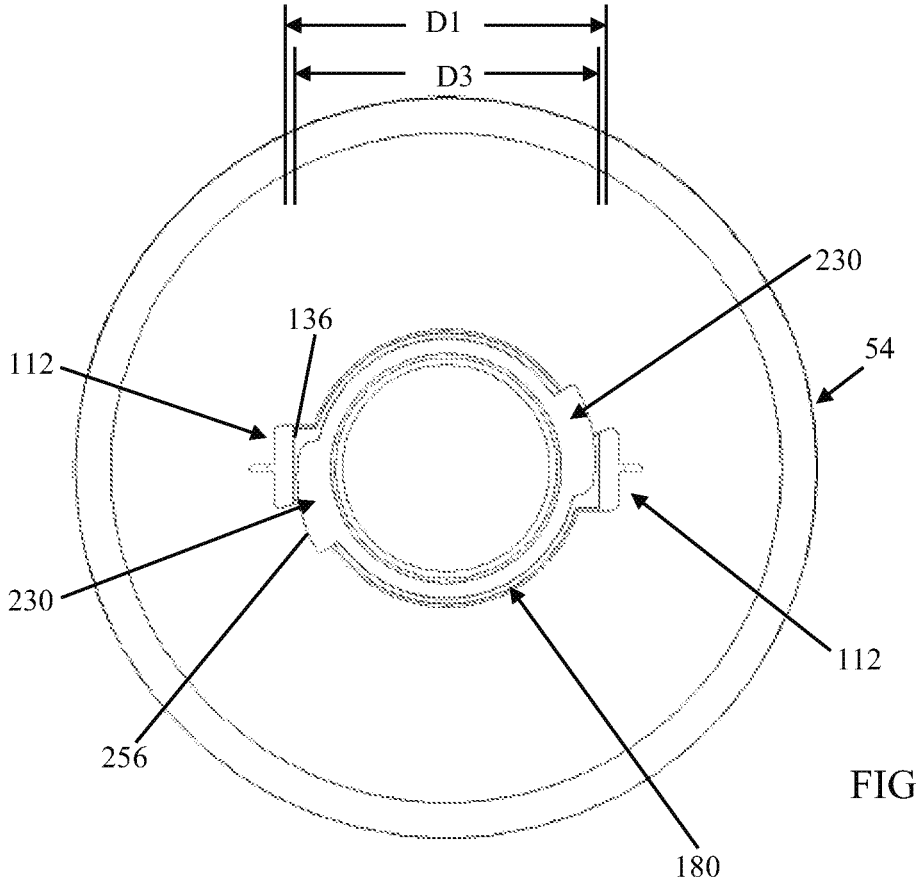

The adaptor 180 is then rotated relative to the lid 54 (and/or vice-versa) about the common axes A, X, in a direction that moves the first end 240 of each of the lock structures 230 toward the first end 124 of a corresponding one of the retention structures 112. For example, relative to the orientation of FIG. 7B, the adaptor 180 is rotated clockwise relative to the lid 54. With this rotation, the shim body 250 of each of the lock structures 230 is directed into the capture region 134 of a corresponding one of the retention structures 112. FIGS. 8A and 8B illustrate initial interface between corresponding pairs of the retention structures 112 and the lock structures 230. Commensurate with the descriptions above, FIG. 8B highlights that the maximum outer diameter D3 collectively established by the lock structures 230 is greater than the clearance diameter D2 collectively established by the retention structures 112, such that the lock structure 230 are radially positioned to interface with corresponding ones of the retention structures 112. However, and as shown in the cross-sectional view of FIG. 8C, the maximum outer diameter D3 is less than the capture diameter D1, such that the guide surface 136 of the retention structures 112 does not overtly contact the guide face 256 of the corresponding lock structure 230 in a manner than might otherwise impede rotation of the adaptor 180 relative to the lid 54 (and/or vice-versa).

Figure 8D:
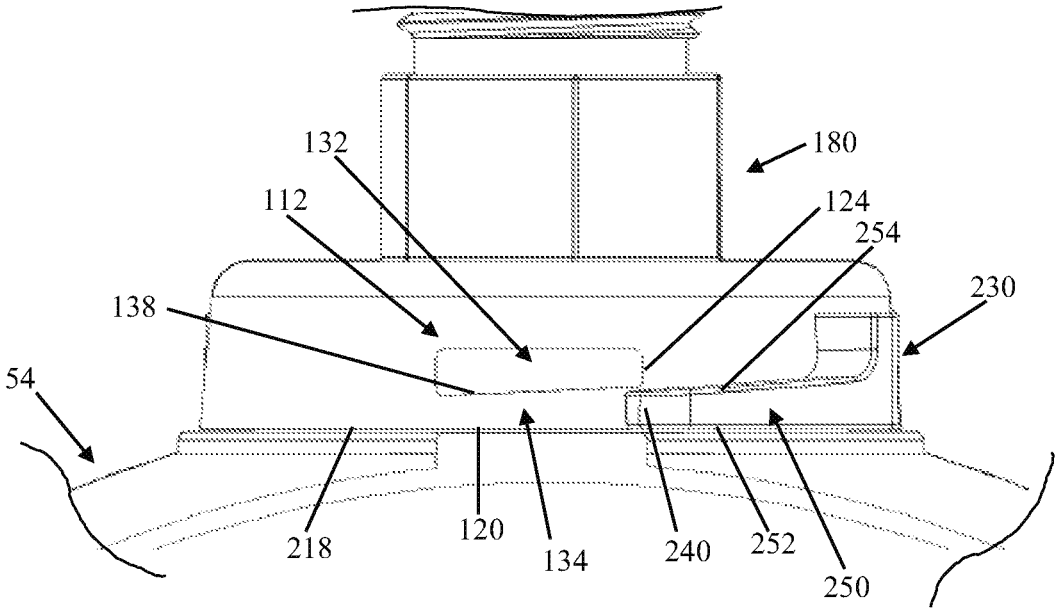

As reflected by the partial cross-sectional view of FIG. 8D, the height $H_S$ (FIG. 5D) of the shim body 250 at the first end 240 of the lock structure 230 is less than the longitudinal spacing L (FIG. 4E) of the capture region 134 at the first end 124 of the retention structure 112. Thus, the shim body 250 is readily directed into the capture region 134, sliding between the contact and engagement surfaces 120, 138. The sliding, planar interface established between the contact surface 120 of the lid 54 and the contact face 218 of the adaptor 180 maintains circumferential alignment of the shim body 250 and the capture region 134 with continued rotation of the adaptor 180 relative to the lid 54 (and/or vice-versa).

As the adaptor 180 is further rotated relative to the lid 54 (and/or vice-versa) (i.e., relative to the orientation of FIG. 8D, the lock structure 230 is caused to move generally leftward relative to the retention structure 112 and further into the capture region 134), a wedge-like coupling or engagement is established between the retention structure 112 and the lock structure 230 due to tapering shape of the capture region 134 and the shim body 250. The locking face 254 of the shim body 250 bears against the engagement surface 138 of the wedge body 132. The angle or plane of sliding engagement (with rotation of the lid 54 and the adaptor 180 relative to one another) between the locking face 254 and the engagement surface 138 directs the adaptor 180 into more robust engagement with the lid 54, forcing the abutment face 252 of the shim body 250 toward the contact surface 120 of the retention structure 112. In some embodiments, the wedge-type, locked engagement can be further promoted by forming at least relevant portions of the lid 54 and the adaptor 180 of differing materials. For example, in some embodiments, the lid 54 is a plastic material and the adaptor 180 is metal (e.g., stainless steel); with these and similar configurations, the plastic-based retention structures 112 can slightly compress or deflect in response to forces exerted by the harder, metal-based shim bodies 250 resulting in a more robust, locked interface.

Figure 9A:
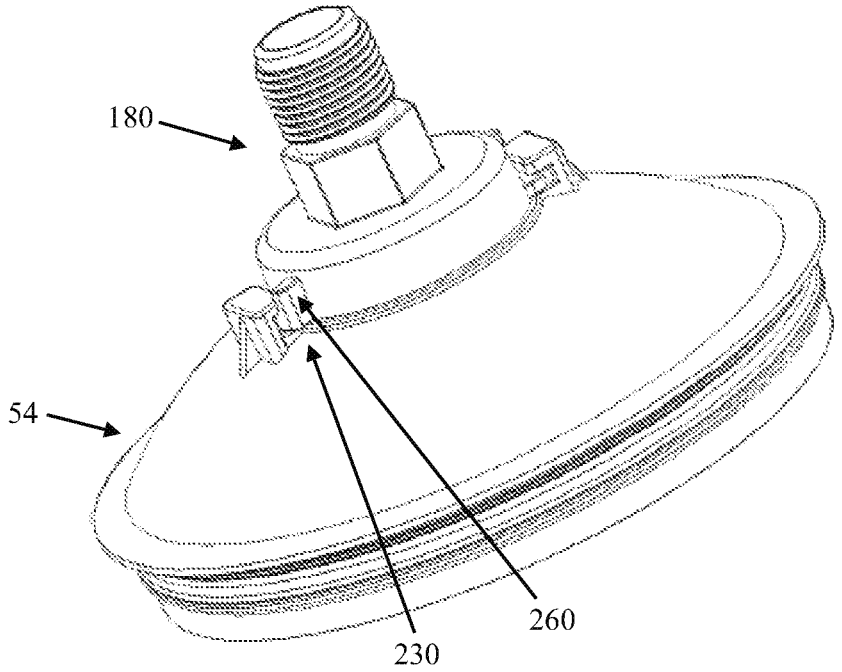
Figure 9B:
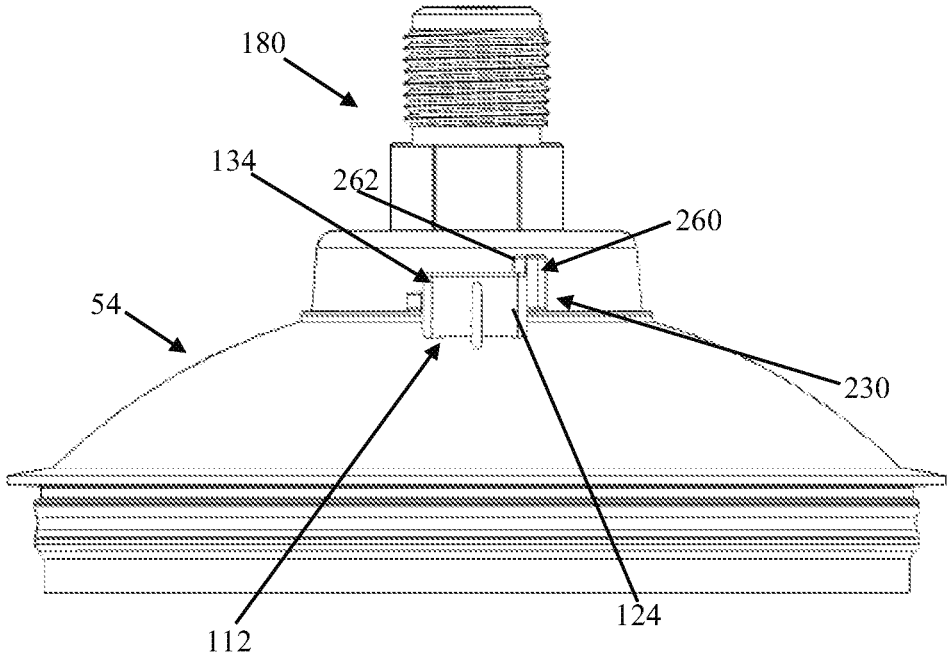

With continued rotation of the adaptor 180 relative to the lid 54 (and/or vice-versa), the shim body 250 of each lock structure 230 will become frictionally and mechanically locked within the capture region 134 of a respective one of the retention structures 112. FIGS. 9A and 9B illustrate a locked state of the adaptor 180 and the lid 54. The optional stop body 260 provided with each of the lock structures 230 prevents over rotation of the adaptor 180 relative to the lid 54 (and/or vice-versa). As best shown in FIG. 9B, the height $H_B$ (FIG. 5D) of the stop body 260 is greater than the longitudinal spacing L (FIG. 4E) of the capture region 134 (referenced generally), with abutment between the stop face 262 and the first end 124 of the retention structure 112 preventing further rotation.

Figure 9C:
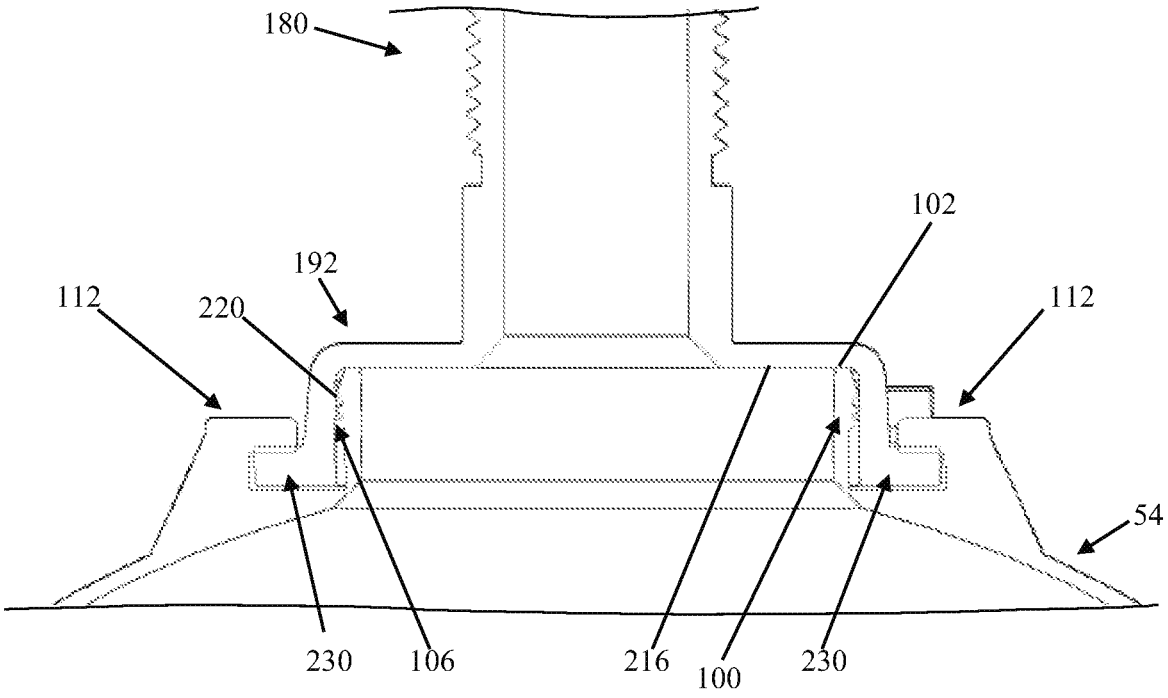

In the locked state, and as reflected by FIG. 9C, a liquid-tight seal is maintained (it being understood that the liquid tight seal can be or is obtained piro to a locked state being achieved). In particular, the leading surface 102 of the spout 100 contacts and seals against the interior radial face 216 of the base 192, and the annular rib(s) 106 of the fluid outlet 64 contacts and seals against the cylindrical inner face 220 of the base 192. Robust, liquid sealing contact between the leading surface 102 and the interior radial face 216 is enhanced as part of the rotational locking operation described above; due to the wedge-like interface between the retention structures 112 and the lock structures 230, the interior radial face 216 is forced into tight contact with the leading surface 102 (i.e., relative to the orientation of FIG. 9C, with rotation as described above, the adaptor 180 is forced or drawn downwardly relative to the lid 54 (and thus the interior radial face 216 is forced or drawn downwardly on to the leading surface 102) to better ensure a liquid-tight seal). In some embodiments, the liquid-tight, sealed interface can be further promoted by forming at least relevant portions of the lid 54 and the adaptor 180 of differing materials. For example, in some embodiments, the lid 54 is a plastic material and the adaptor 180 is metal (e.g., stainless steel); with these and similar configurations, the plastic-based spout 100 and annular ribs 106 of the lid 54 can slightly compress or deflect in response to forces exerted by the harder, metal-based base 192 resulting in a more robust, sealing contact between the components.

Following use, the adaptor 180 can be released from the lid 54 by rotating the adaptor 180 relative to the lid 54 in an opposite direction (e.g., counterclockwise) to withdraw the lock structures 230 from the corresponding retention structures 112. Once disengaged, the adaptor 180 can be separated from the lid 54. A reversed camming-type interface between the retention structures 112 and the lock structures 230 can occur with rotation of the adaptor 180 (i.e., an interface in reverse of the above descriptions) in some embodiments, serving to assist in releasing any seal between the adaptor 180 and the lid 54. Once disengaged, the adaptor 180 can be separated from the lid 54.

As mentioned above, in some embodiments, the lid 54 and the adaptor 180 can be formed of different materials. For example, the lid 54 can be a plastic component (e.g., molded plastic), and the adaptor 180 can be metal (e.g., stainless steel). With these optional constructions, following a spraying operation the adaptor 180 can easily be cleaned and re-used, and the lid 54 can be viewed as a disposable item.

Returning to FIG. 3, while the above descriptions have provided the complementary second connection format 72 as part of the adaptor 180 (FIG. 5A), other configurations are also acceptable. For example, the second connection format 72 can be permanently assembled to or provided as an integral part of a spray gun (e.g., the second connection format 72 as described above can be provided as or at the inlet port 48 (FIG. 1) of the spray gun 30 (FIG. 1)). That is to say, the spray gun reservoir connector systems of the present disclosure do not require an adaptor.

Figure 10:
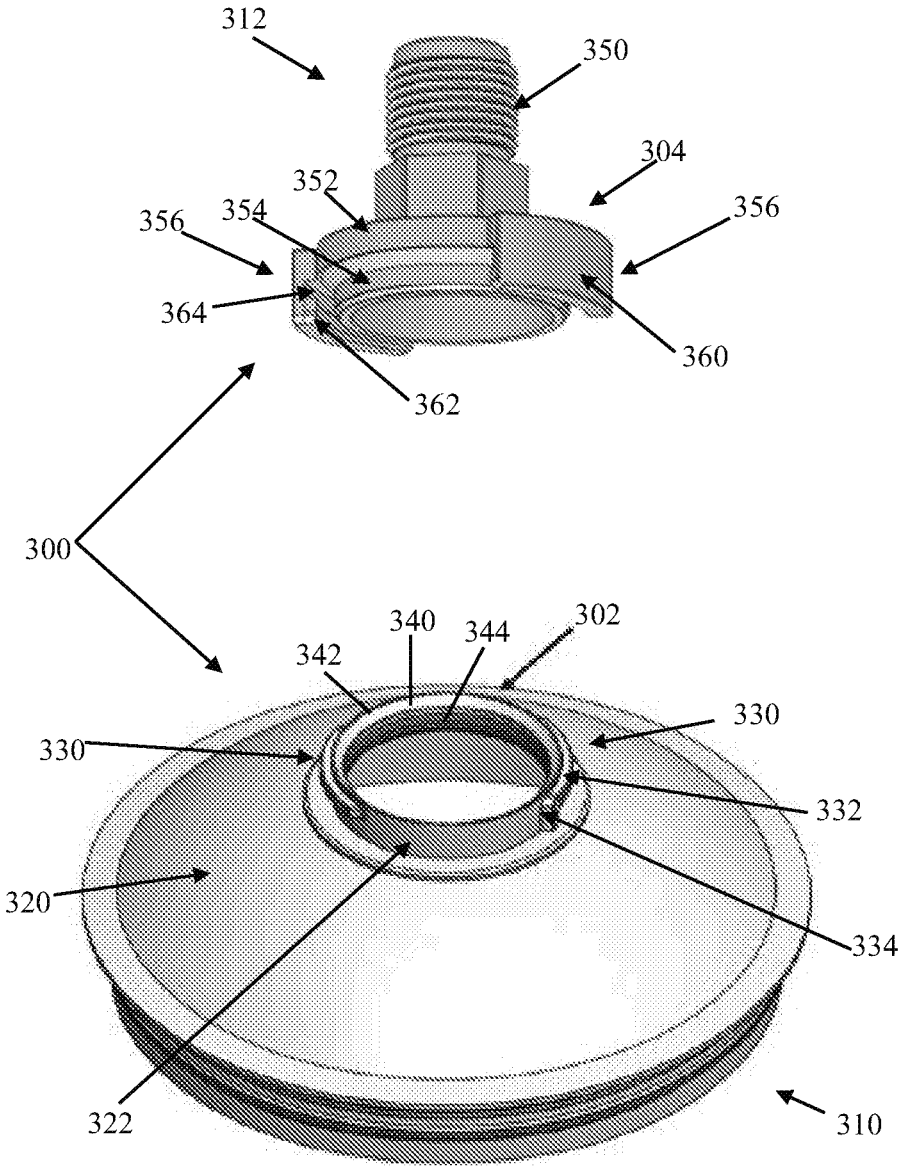
FIG. 10 is an exploded, perspective view of another spray gun reservoir connector system in accordance with principles of the present disclosure and incorporated into a reservoir lid and an adaptor.

In addition, the location of the first and second connection formats 56, 72 can be reversed. In other embodiments, then, the second connection format 72 can be formed or provided with the lid 54, and the first connection format 56 can be formed or provided with the spray gun inlet 70 (e.g., adaptor, spray gun inlet port, etc.). For example, FIG. 10 illustrates portions of an alternative spray gun reservoir connector system 300 including complementary first and second connection formats 302, 304 (referenced generally). The first connection format 302 is provided as part of a lid 310; the second connection format 304 is provided as part of a spray gun inlet, such as an adaptor 312 as shown.

Figure 11:
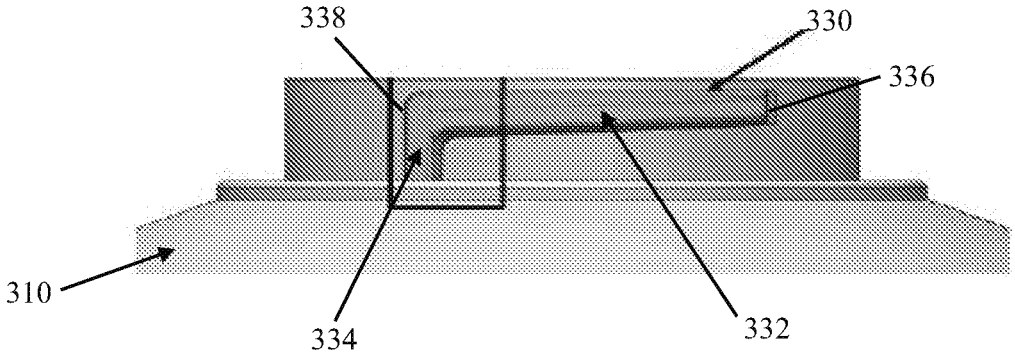
FIG. 11 is an enlarged side view of a portion of the lid of FIG. 10.

The lid 310 can be akin to the lid 54 (FIG. 2) described above, and generally includes a wall 320 and a fluid outlet including a spout 322. The first connection format 302 includes a plurality of lock structures 330 circumferentially spaced from one another along an exterior of the spout 322. The lock structures 330 can be highly akin to the lock structures 230 (FIG. 5A) described above, with the spout 322 being functionally akin to the base 192 (FIG. 5A). As further shown in FIG. 11, each of the lock structures 330 includes a shim body 332 and an optional stop body 334. The shim body 332 can have any of the features described above with respect to the shim body 250 (FIG. 5A), and generally provides an expanding height from a first end 336 toward a second end 338. The stop body 334 is located at the second end 338, and can have any of the features described above with respect to the stop body 260 (FIG. 5A).

Returning to FIG. 10, the lid 310 can provide one or more sealing features that are optionally considered part of the first connection format 302. For example, an angled face seal 340 can be formed along an interior of the spout 322 proximate a leading end 342. Additionally or alternatively, an annular rib seal 344 can be formed along the interior of the spout 322 at a location spaced from the leading end 342. Other sealing configurations are also envisioned.

The adaptor 312 can be akin to the adaptor 180 (FIG. 5A) described above, and generally includes a tubular member 350. The second connection format 304 projects from the tubular member 350 and includes a platform 352, a ring 354, and a plurality of retention structures 356. The platform 352 has an annular shape, defining an outer diameter greater than that of the tubular member 350. The ring 354 is coaxial with the tubular member 350, and can be viewed as being functionally akin to the spout 100 (FIG. 4A) described above. An outer diameter of the ring 354 is less than an inner diameter of the spout 322 such that the ring 354 can nest within the spout 322. A sealing feature may be provided at the outer diameter of the ring 354 to provide additional sealing and retention against the spout 322. The retention structures 356 can be highly akin to the retention structures 112 (FIG. 4A) described above, and include a support body 360 and a wedge body 362. Surfaces of the platform 352, the support body 360 and the wedge body 362 combine to define a capture region 364 commensurate with the above descriptions, sized to slidably receive a corresponding one of the shim bodies 332 in a wedge-type engagement.

The ring 354 can be provided as a separate component that is installed to the connection format. In this way, more complex geometries are attainable than would otherwise be feasible with conventional manufacturing techniques.

Figure 12:
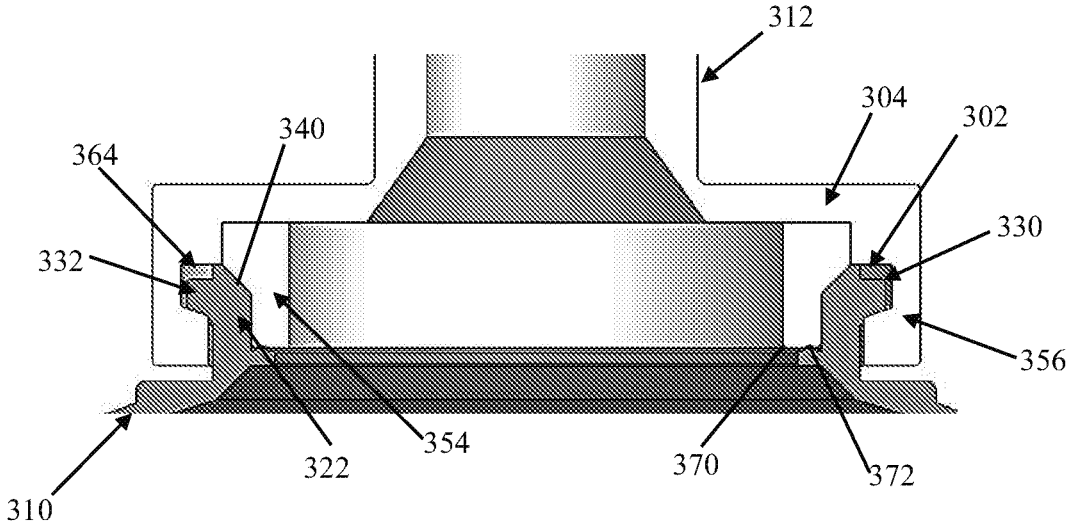
FIG. 12 is a simplified cross-sectional view of a portion of the lid and adaptor of FIG. 10 upon final assembly.

Coupling of the adaptor 312 to the lid 310 is achieved in a manner highly similar to previous embodiments. The adaptor 312 is axially aligned with the spout 322, with the retention structures 356 being rotationally off-set relative to the lock structures 330. The adaptor 312 is then advanced on to the lid 310, with the ring 354 nesting within the spout 322. The adaptor 312 is then rotated relative to the lid 310 (and/or vice-versa) to bring the retention structures 356 into engagement with respective ones of the lock structures 330. A wedge-type interface in provided, with the adaptor 312 being drawn into robust contact with the lid 310 as described above. With further rotation, the shim body 332 of each of the lock structures 330 becomes frictionally and mechanically locked within the capture region 364 of the corresponding retention structure 356. Where provided, the stop body 334 of each of the lock structures 330 contacts the corresponding retention structure 356 to prevent over-rotation of the adaptor 312. FIG. 12 is a simplified representation of a locked arrangement between the lid 310 and the adaptor 312 (and thus between the complementary first and second connection formats 302, 304 (referenced generally)). The shim body 332 of each of the lock structures 330 is wedged within the capture region 364 of the corresponding retention structure 356. At least one liquid-tight seal is provided at a contacting interface between the angled face seal 340 of the spout 322 and the ring 354 of the adaptor 312. In the embodiment of FIG. 12, a second liquid-tight seal is provided at a contacting interface between a leading end 370 of the ring 354 and an annular rib seal 372 provided with the lid 310. It will be understood that a location of the annular rib seal 372 in the illustration of FIG. 12 differs from the annular rib seal 342 of FIG. 10, and reflects an alternative sealing approach.

While the above descriptions have provided the complementary second connection format 304 as part of the adaptor 312, other configurations are also acceptable. For example, the second connection format 304 can be permanently assembled to or provided as an integral part of a spray gun (e.g., the second connection format 304 as described above can be provided as or at the inlet port 48 (FIG. 1) of the spray gun 30 (FIG. 1)).

Figure 13:
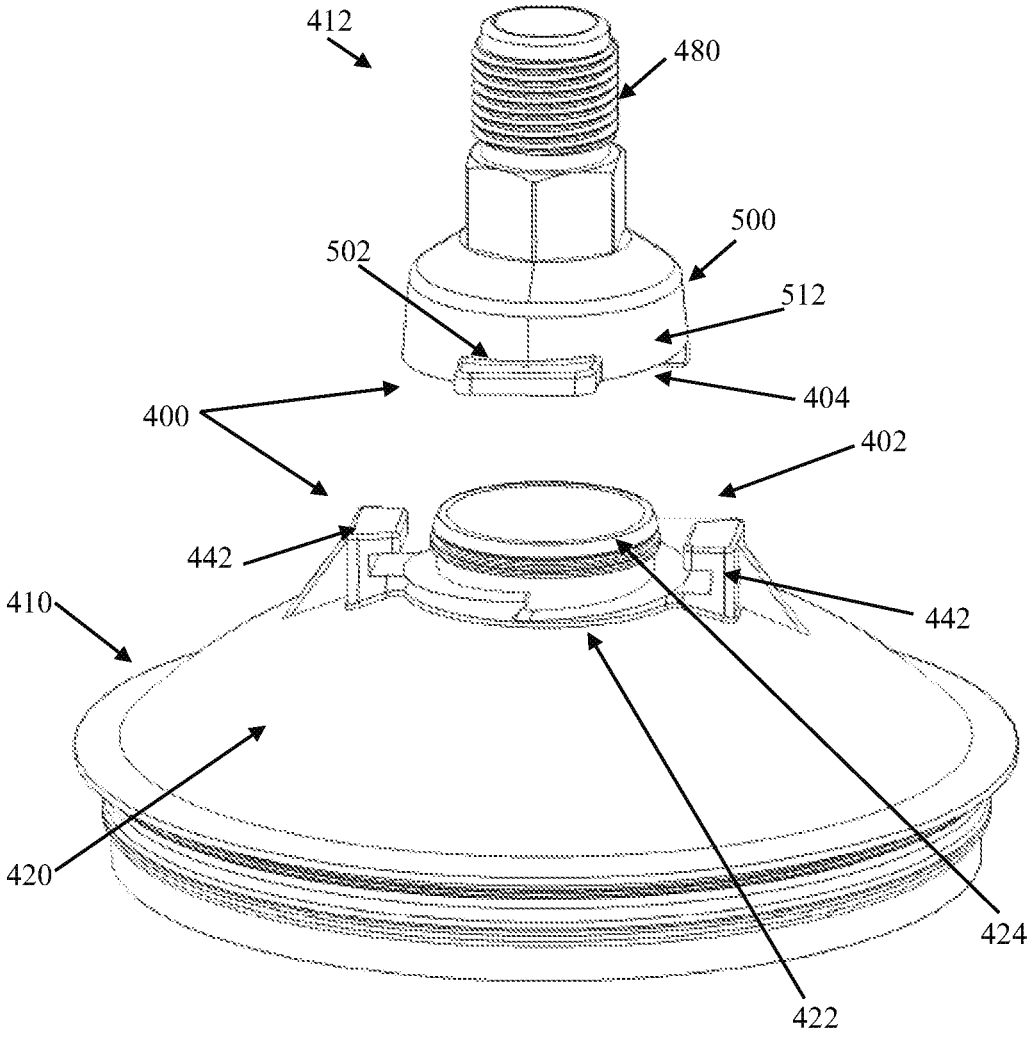
FIG. 13 is an exploded, perspective view of another spray gun reservoir connector system in accordance with principles of the present disclosure and incorporated into a reservoir lid and an adaptor.

FIG. 13 illustrates portions of an alternative spray gun reservoir connector system 400 including complementary first and second connection formats 402, 404 (referenced generally) in accordance with principles of the present disclosure. The first connection format 402 is provided as part of a lid 410; the second connection format 404 is provided as part of a spray gun liquid inlet, such as an adaptor 412 as shown adapted to connect to a spray gun.

The lid 410 is shown in greater detail in FIGS. 14A-14E and in many respects can be highly akin or identical to the lid 54 (FIG. 4A) described above. The lid 410 generally includes a wall 420 and a fluid outlet 422. The fluid outlet 422 includes a spout 424 along with optional sealing features as described above, such as a leading surface 426 of the spout 424 and/or one or more annular ribs 428 formed along an exterior of the spout 424 proximate the leading surface 426. Where provided, the sealing features can be considered components of the first connection format 402 in some embodiments.

Figure 14A:
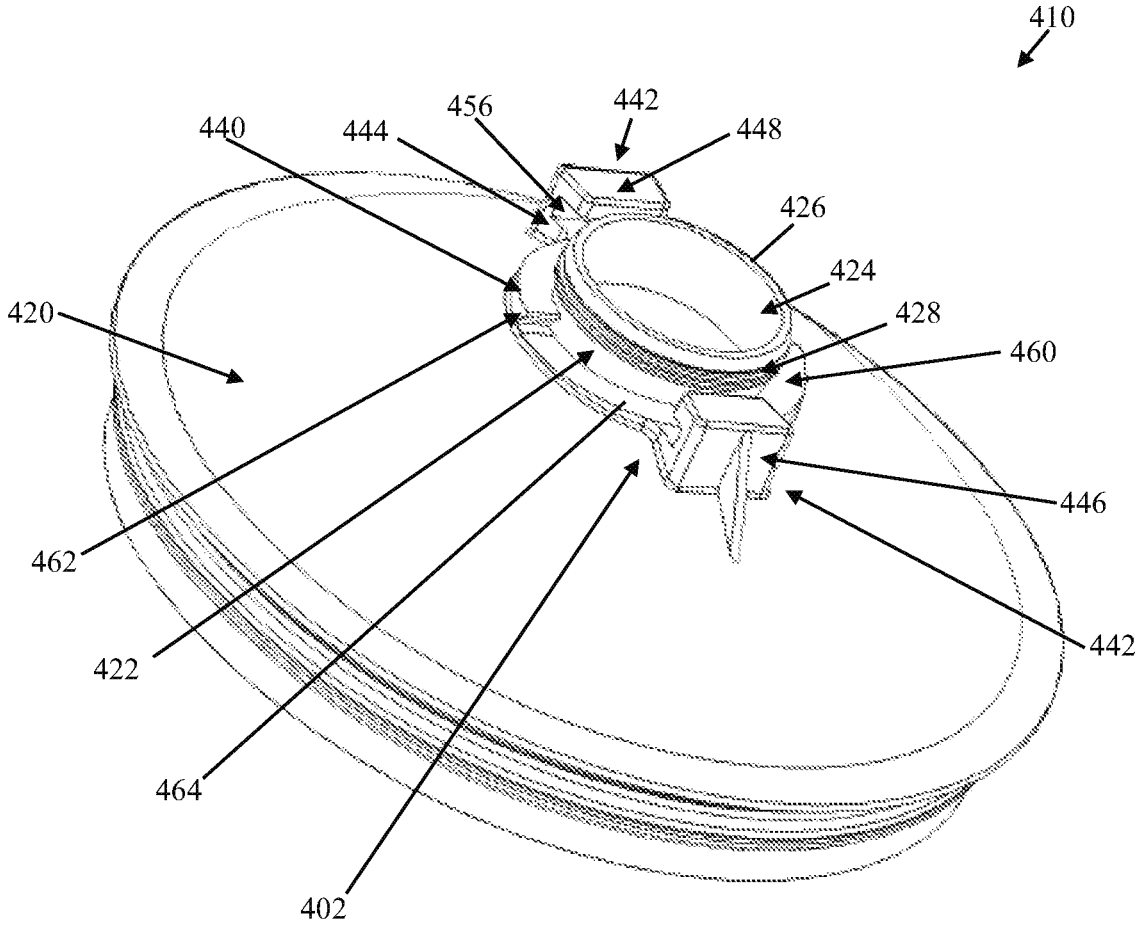
FIG. 14A is a perspective view of the lid of FIG. 13.
Figure 14B:
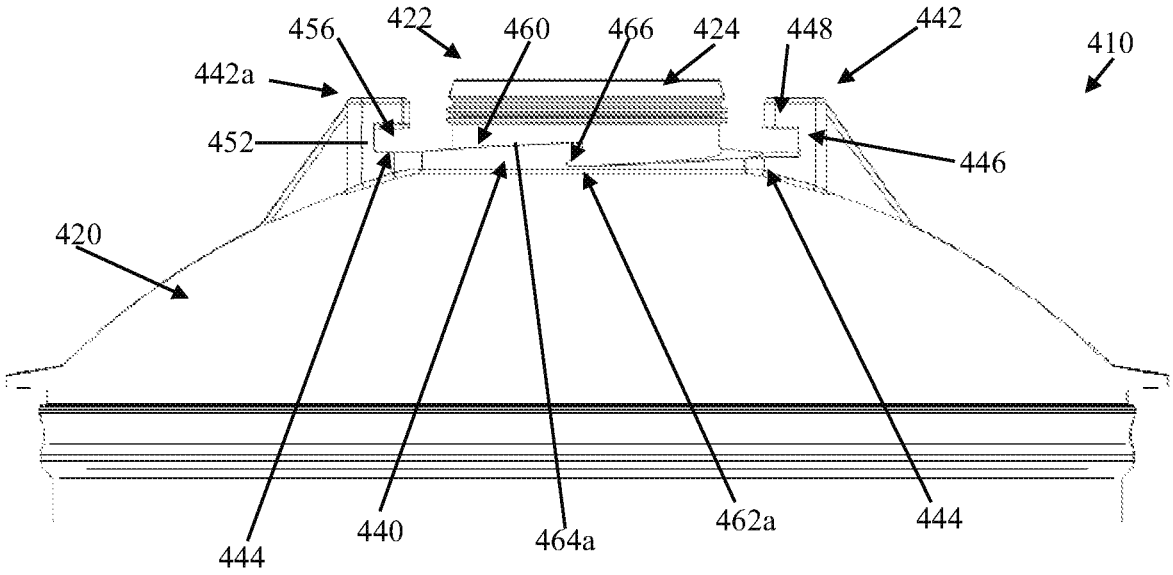
FIG. 14B is a front view of the lid of FIG. 14A.

The first connection format 402 (referenced generally in FIG. 14A) includes a platform 440 and a plurality of retention structures 442. The retention structures 442 can be highly akin to the retention structures 112 (FIG. 4A) described above, and are circumferentially spaced from one another at locations radially spaced from the spout 424. In general terms, each of the retention structures 442 includes a floor 444, a support body 446 and a wedge body 448. The floor 444 defines a contact surface 450 that is generally aligned with a surface of the platform 440 in a region of the retention structure 442 (as best shown in the cross-sectional view of FIG. 14E). The support body 446 projects from the floor 444 and defines a guide surface 452 (FIG. 14B). The wedge body 448 extends radially inwardly from the support body 446 opposite the floor 444 and defines an engagement surface 454 best seen in FIG. 14E. The surfaces 450-454 combine to define a capture region 456 having the tapering or angular shape reflected by FIG. 14E. For example, and relative to the orientation of FIG. 14E, a shape of the capture region 456 has a vertically downward component in extension between a first end 458 and a second end 459. In other words, a shape of the capture region 456 can be akin to a segment of a helix as the capture region 456 revolves about the spout 424. Other shapes or configurations are also envisioned. In yet other embodiments, three or more of the retention structures 442 can be provided.

Figure 14C:
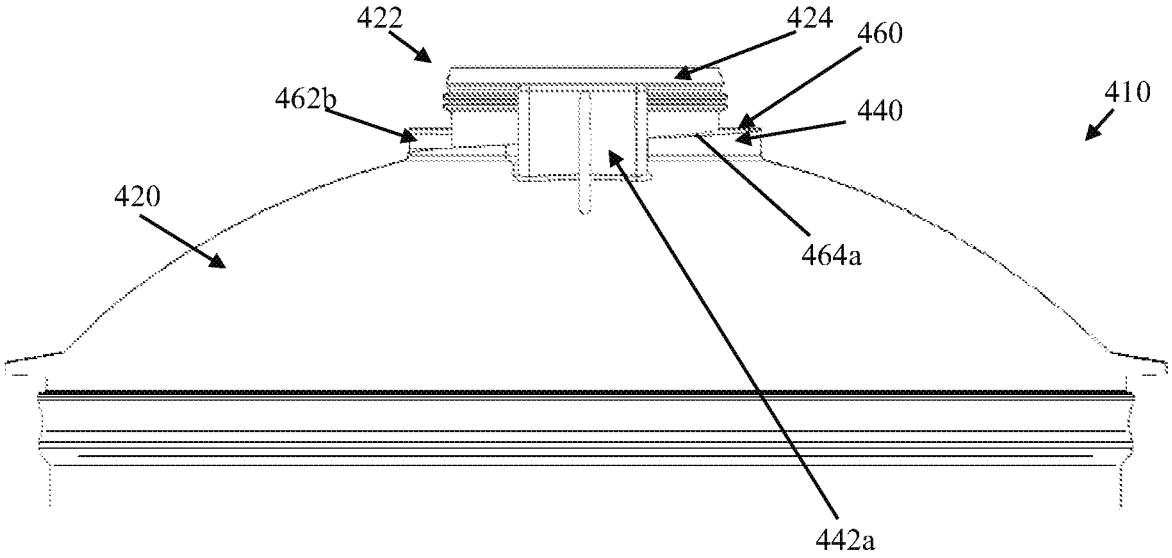
FIG. 14C is a side view of the lid of FIG. 14A.
Figure 14D:
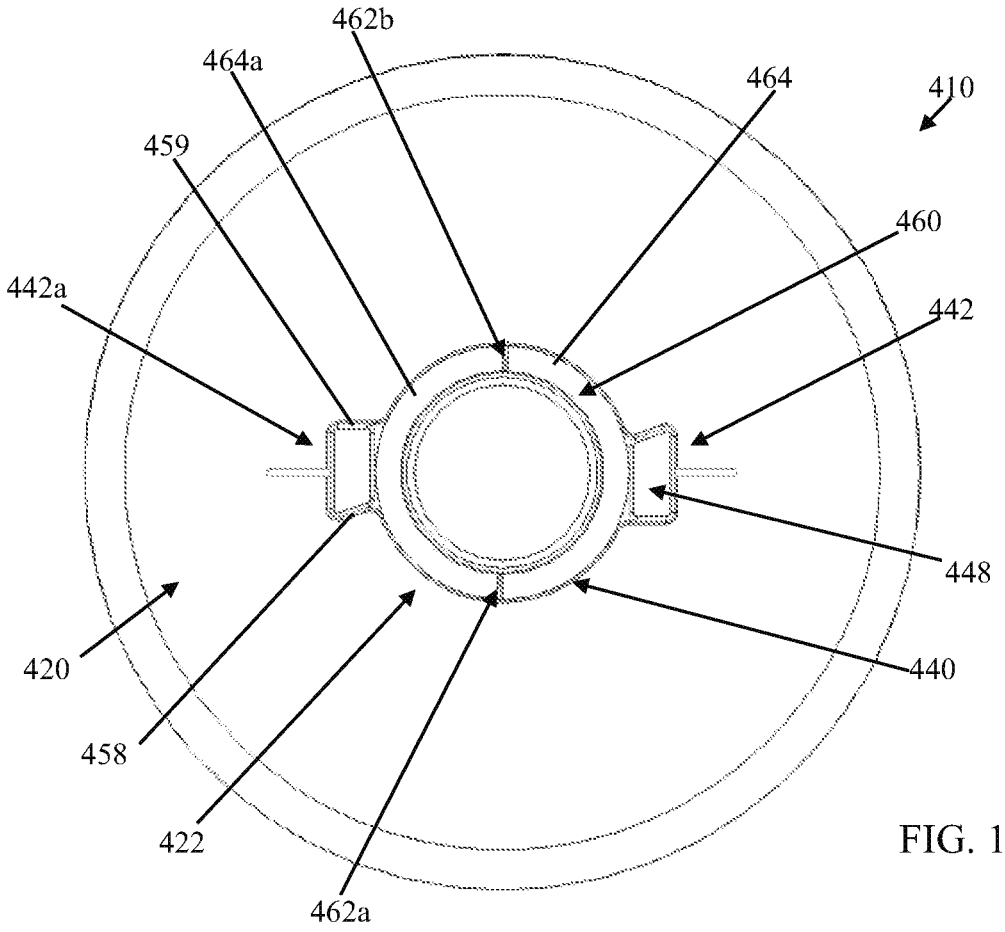
FIG. 14D is a top view of the lid of FIG. 14A.
Figure 14E:
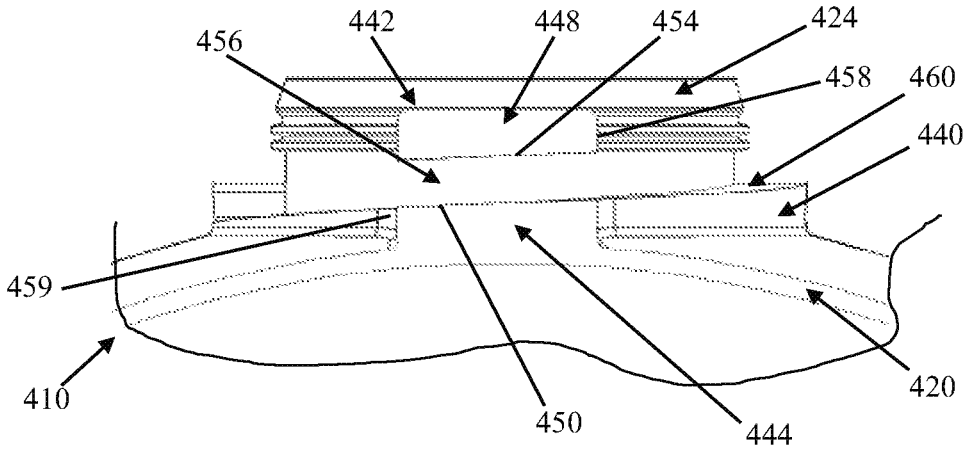
FIG. 14E is an enlarged cross-sectional view of a portion of the lid of FIG. 14A.

The platform 440 is functionally akin to the platform 110 (FIG. 4A) described above, and defines a ramp surface 460. In contrast to other embodiments discussed above, the platform 440 is configured such that the ramp surface 460 has a varying shape about the spout 424. In particular, and as best shown in FIGS. 14B-14D, a plurality of undercuts 462 are defined in the platform 440, generating a plurality of ramp segments 464. The ramp surface 460 along each of the ramp segments 464 has a partial helical shape, transitioning longitudinally as the ramp segment 464 revolves about the spout 424. For example, a first ramp segment **464*a* is identified in FIGS. 14B-14D, and is defined between first and second undercuts 462*a*, 462*b*. The first ramp segment 464*a* is located to correspond with a first retention structure 442*a*. With these conventions in mind, the ramp surface 460 of the first ramp segment 464*a* tapers longitudinally downward from the first undercut 462*a* to the second undercut 462*b*. Relative to upright orientation of FIG. 14B, the ramp surface 460 of the first ramp segment 464*a* is vertically "above" the floor 444 of the first retention structure 442*a* at a location of the first undercut 462*a*, is vertically aligned with the floor 444 in a region of the first retention structure 442*a*, and is vertically "below" the floor at a location of the second undercut 462*b*. A shoulder 466 (FIG. 14B) is defined at each of the undercuts 462 for reasons made clear below. As best reflected by FIG. 14D, at least one undercut 462 is formed between circumferentially adjacent ones of the retention structures 442; in some embodiments, a single one of the undercuts 462 is located at a circumferential midpoint between a pair of the retention structures 442. In related embodiments, the number of undercuts 462 (and thus the number of ramp segments 464) corresponds with the number of retention structures 442**.

Returning to FIG. 13, the adaptor 412 can be highly akin to the adaptor 180 (FIG. 5A) described above, and generally includes a tubular member 480. The tubular member 480 can include any of the features described above with respect to the tubular member 190 (FIG. 5A). The second connection format 404 includes a base 500 and a plurality of lock structures 502. The base 500 projects from the tubular member 480, and carries the lock structures 502. The lock structures 502, in turn, are configured to selectively interface with corresponding ones of the retention structures 442 as described below.

Figure 15A:
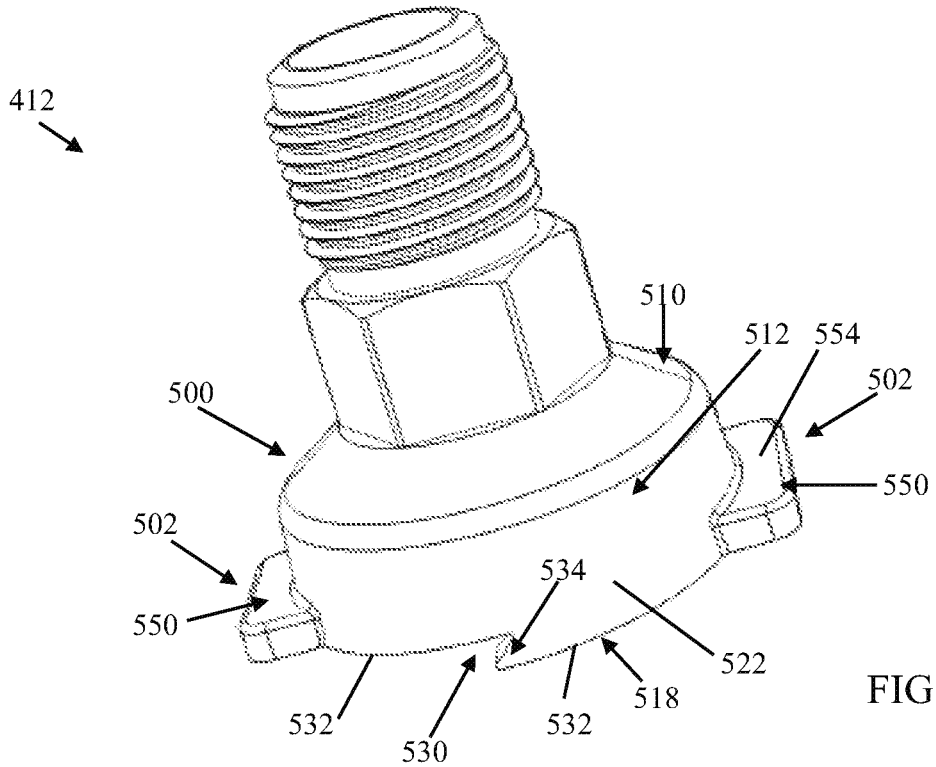
FIG. 15A is a perspective view of the adaptor of FIG. 13.
Figure 15B:
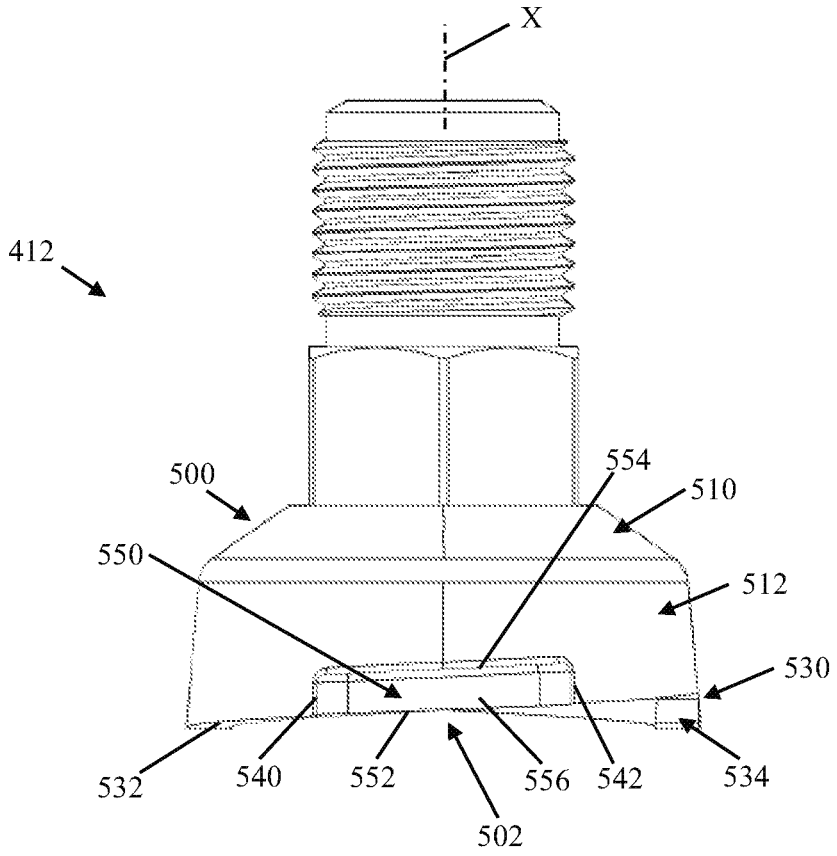
FIG. 15B is a side view of the adaptor of FIG. 15A.
Figure 15C:
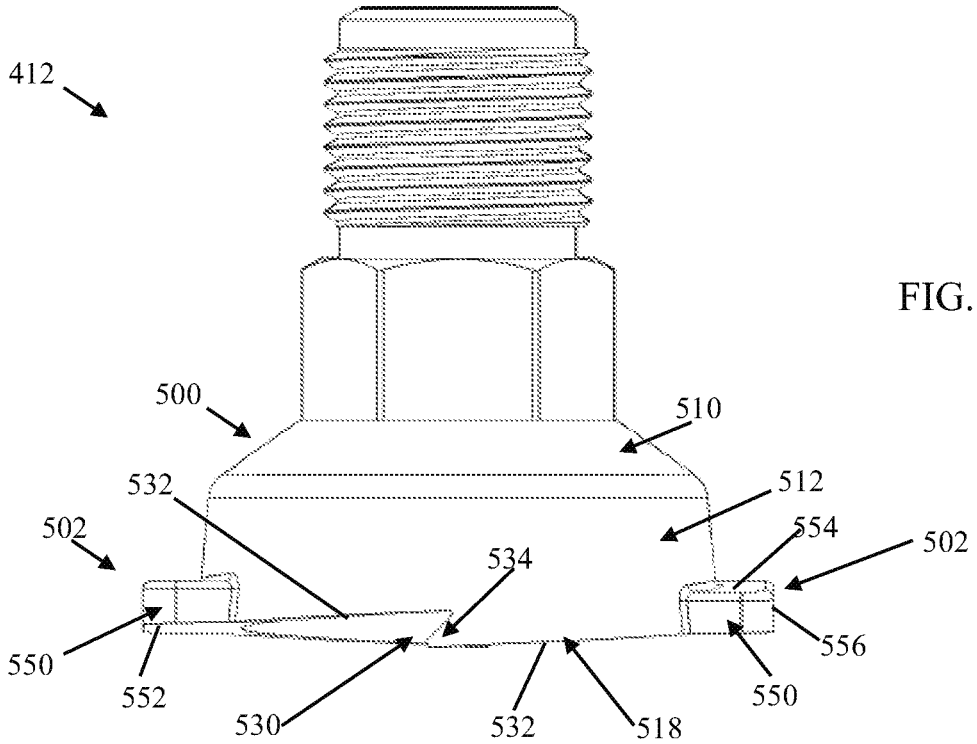
FIG. 15C is a front view of the adaptor of FIG. 15A.
Figure 15D:
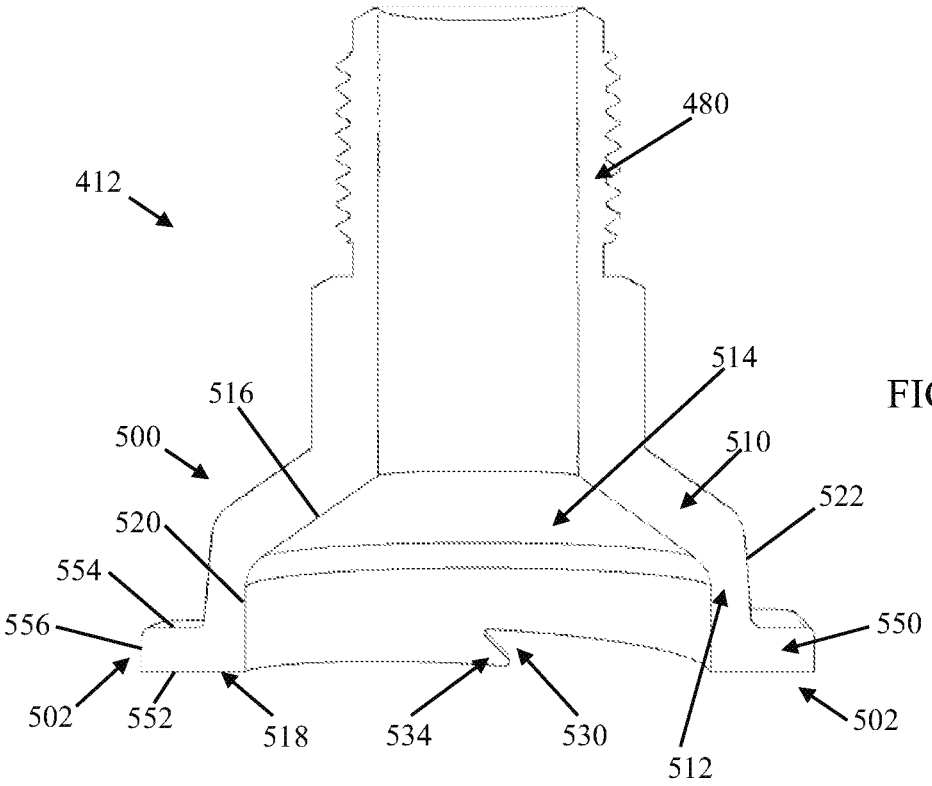
FIG. 15D is a cross-sectional view of the adaptor of FIG. 15A.

The adaptor 412 is shown in greater detail in FIGS. 15A-15D. The base 500 includes a shoulder 510 and a ring 512. As best shown in FIG. 15D, the shoulder 510 and the ring 512 combine to define a chamber 514 that is open to the passageway of the tubular member 480 and that is configured to receive the spout 424 (FIG. 14A) of the lid 410 (FIG. 14A). The shoulder 510 extends radially outwardly and downwardly from the tubular member 480, and defines an interior face 516. The ring 512 projects longitudinally from an outer perimeter of the shoulder 510 in a direction opposite the tubular member 480 and terminates at a contact face 518. Further, the ring 512 defines a cylindrical inner face 520 and a cylindrical outer face 522. An inner diameter of the ring 512 (e.g., a diameter defined by the cylindrical inner face 520 corresponds with (e.g., approximates or is slightly greater than) an outer diameter of the spout 424. An outer diameter of the ring 512 can expand in extension to the contact face 518 or can be uniform. Regardless, a maximum outer diameter of the ring 512 (e.g., a maximum diameter defined by the cylindrical outer face 522) is selected to nest within a clearance diameter collectively established by the retention structures 442 (FIG. 14A) commensurate with previous explanations.

Geometries of a shape of the contact face 518 are commensurate with those described above with respect to the ramp surface 460 (FIG. 14A). In particular, a plurality of undercuts 530 are formed along the contact face 518, generating a plurality of track segments 532. The number, circumferential location, and shape of the undercuts 530 in the contact face 518 corresponds with the undercuts 462 (FIGS. 14B-14D) in the platform 440 (FIG. 14A) as described above. The contact face 518 along each of the track segments 532 generates a partial helix shape, and forms a tab 534 at each of the undercuts 530.

In some embodiments, the lock structures 502 are identical, and each defines a first end 540 opposite a second end 542 in circumferential extension along the ring 512 as best seen in FIG. 15B. The lock structure 502 can be akin to the lock structure 230 (FIG. 5A) described above, and includes a shim or wedge body 550 defining an abutment face 552, a locking face 554, and a guide face 556. The abutment face 552 projects from the ring 512 at or immediately adjacent the contact face 518. In some embodiments, a shape of the abutment face 552 matches a corresponding shape of the contact face 518, and thus can have an angled orientation (e.g., akin to a segment of a helix).

The locking face 554 is formed longitudinally opposite the abutment face 552 to define a height of the shim body 550. In some embodiments, a plane of the locking face 552 is substantially parallel with a plane of the abutment face 552, and thus generates a shape or geometry relative to the ring 512 akin to a segment of a helix as best reflected by the view of FIG. 15B. With this construction, a vertical location of the shim body 550 relative to the ring 512 changes as the shim body 550 revolves about the ring 512, with the first end 540 being vertically "below" the second end 542 relative to the upright orientation of FIGS. 15A-15D. The lock structures 502 are arranged about the ring 512 such that the angular orientation of the shim body 550 of each lock structure 502 is in the same rotational direction relative to a central axis X. For example, relative to the orientation of FIG. 15B, the shim body 550 of each of the lock structures 520 extends downwardly in the clockwise direction (e.g., the vertically lower first end 540 is rotationally "ahead" of the corresponding, vertically higher second end 542 in the clockwise direction).

The number of lock structures 502 provided with the adaptor 412 corresponds with the number of retention structures 442 (FIG. 14A) provided with the lid 410 (FIG. 14A). Thus, three or more of the lock structures 502 can be included with other embodiments. In contrast to the lock structures 230 (FIG. 5A) described elsewhere, the lock structures 502 need not include a stop body.

Returning to FIG. 13, coupling of the lid 410 and the adaptor 412 is commensurate with previous explanations. First, the ring 512 is aligned with the spout 424. In the arrangement of FIG. 13, the adaptor 412 is rotationally arranged such that the lock structures 502 are rotationally off-set from the retention structures 442. The adaptor 412 is then directed on to the lid 410 (and/or vice-versa), with the spout 424 nesting within the base 500.

Figure 16A:
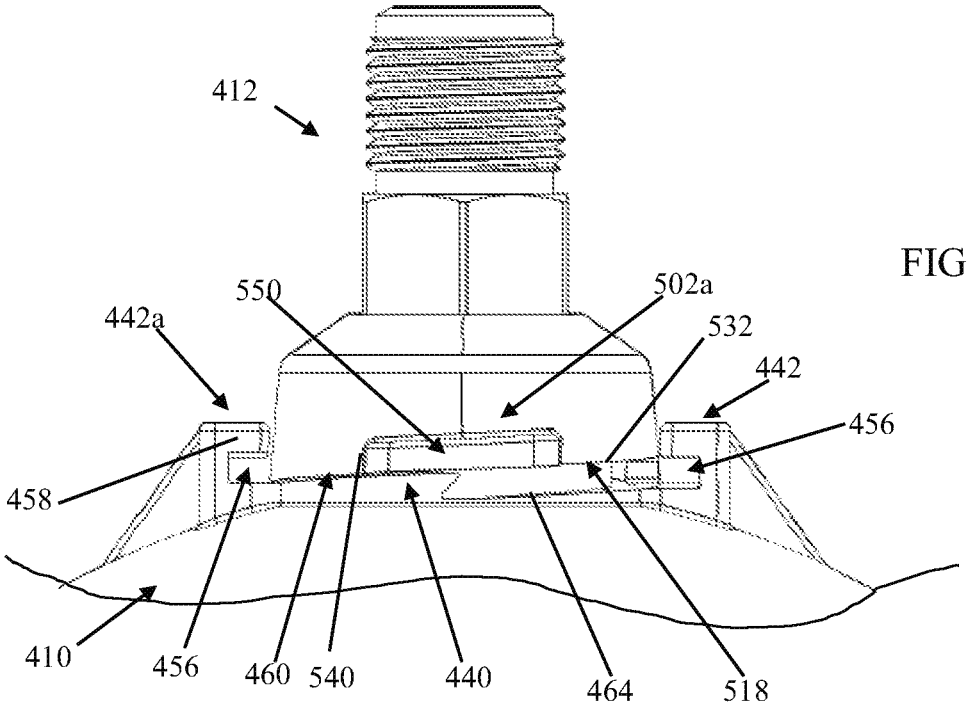
FIGS. 16A-17C illustrate coupling the lid of FIG. 14A with the adaptor of FIG. 15A.
Figure 16B:
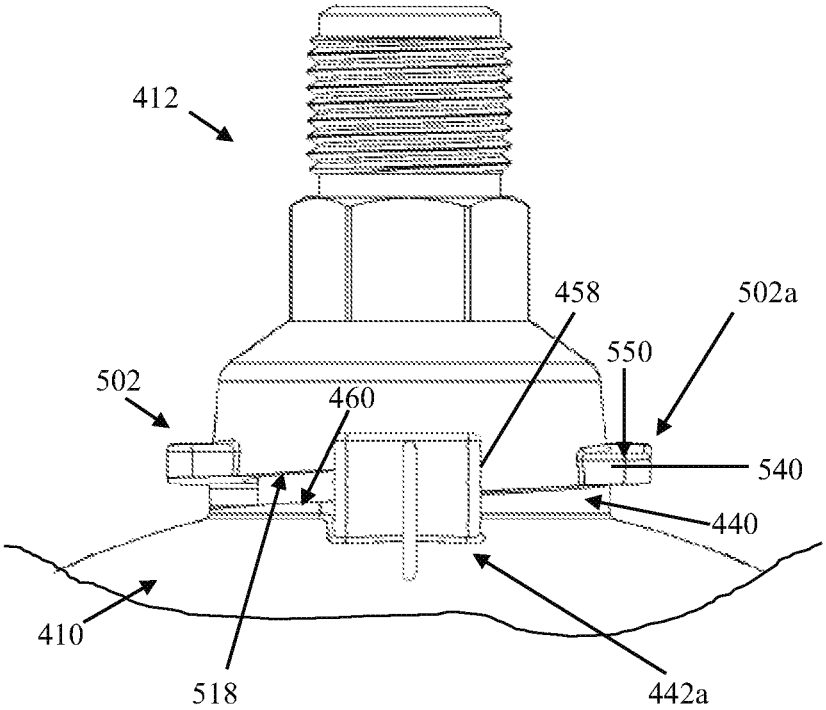

In the initial assembly state of FIGS. 16A and 16B, the adaptor 412 has been placed on to the lid 410 as described above, with the lock structures 502 being rotationally spaced from the retention structures 442. The contact face 518 of the adaptor 412 bears against the ramp surface 460 of lid platform 440. Due to the partial helix shape of the ramp surface 460 along the ramp segments 464 of the lid 410 and of the contact face 518 along the track segments 532 of the adaptor 412 as described above, the lock structures 502 are located vertically "above" the capture region 456 of each of the retention structures 442 (relative to the orientation of FIGS. 16A and 16B).

The adaptor 412 is then rotated relative to the lid 410 (and/or vice-versa), directing each of the lock structures 502 into engagement with corresponding ones of the retention structures 442. For example, and with reference to the first retention structure 442*a* and the first lock structure 502*a* identified in FIGS. 16A and 16B, the adaptor 412 can be rotated (e.g., clockwise) such that the first end 540 of the shim body 550 approaches and then enters the capture region 456 at the first end 458 of the first retention structure 442*a*. Due to the sliding interface between the ramp surface 460 and the contact face 518 and the corresponding helical-like shapes, as the adaptor 412 is rotated, the adaptor 412 vertically drops or lowers relative to the retention structures 442 such that as the first lock structure 502*a* nears the first end 458 of the first retention structure 442*a*, the first end 540 of the first lock structure 502*a* comes into alignment with the capture region 456 at the first end 458 of the first retention structure 442*a*.

Figure 17A:
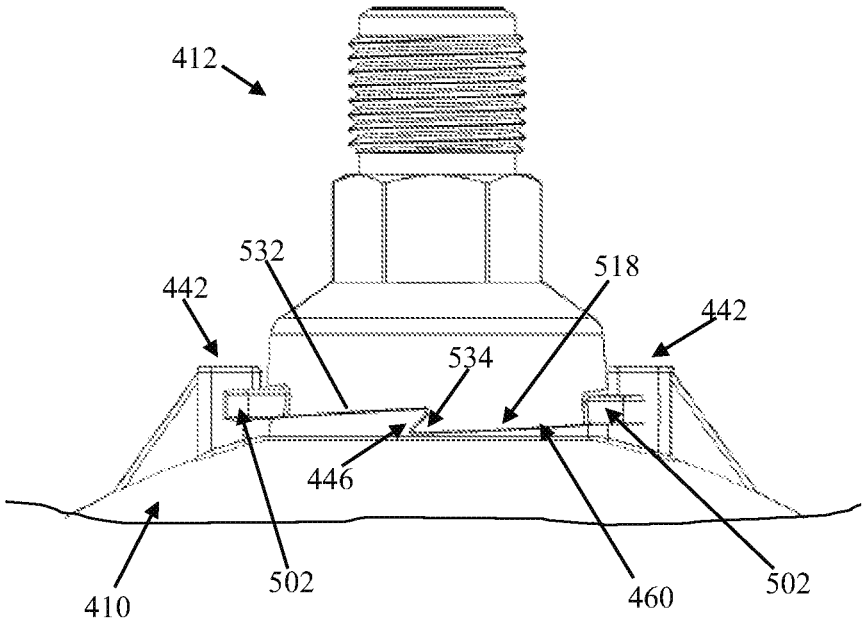
Figure 17B:
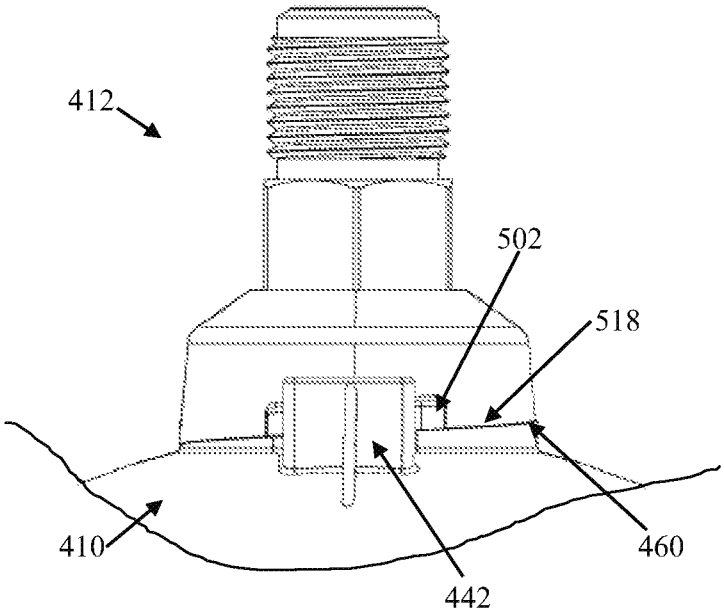
Figure 17C:
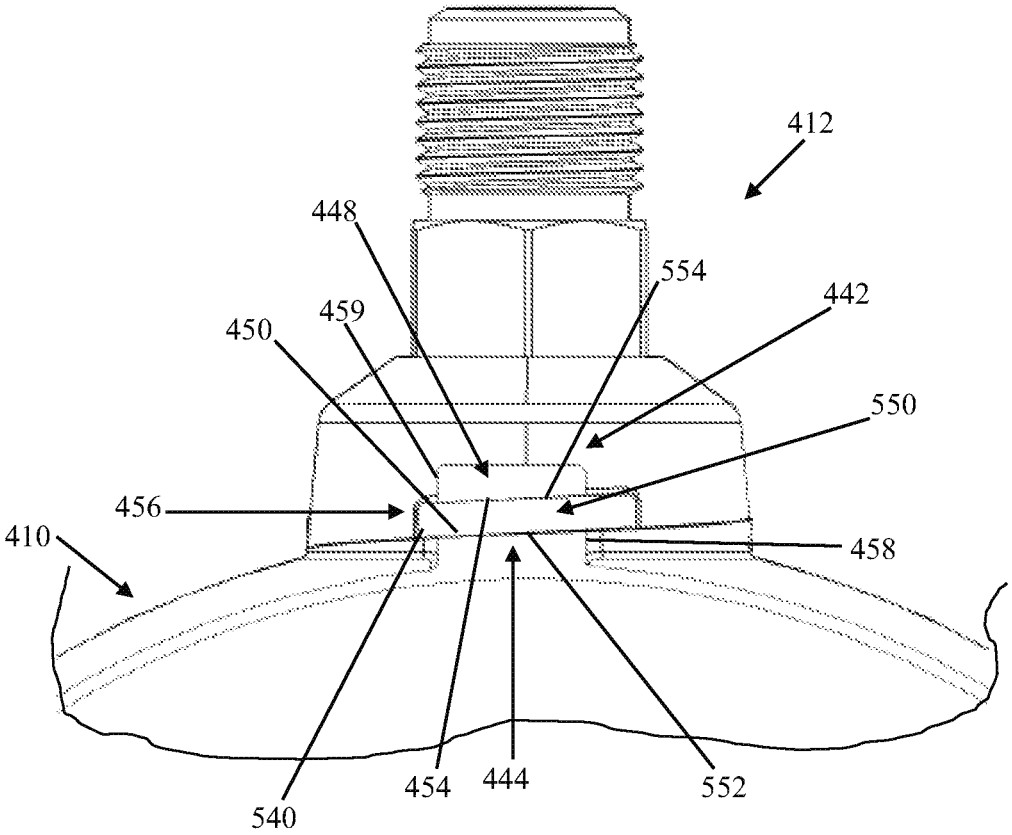
Figure 18A:
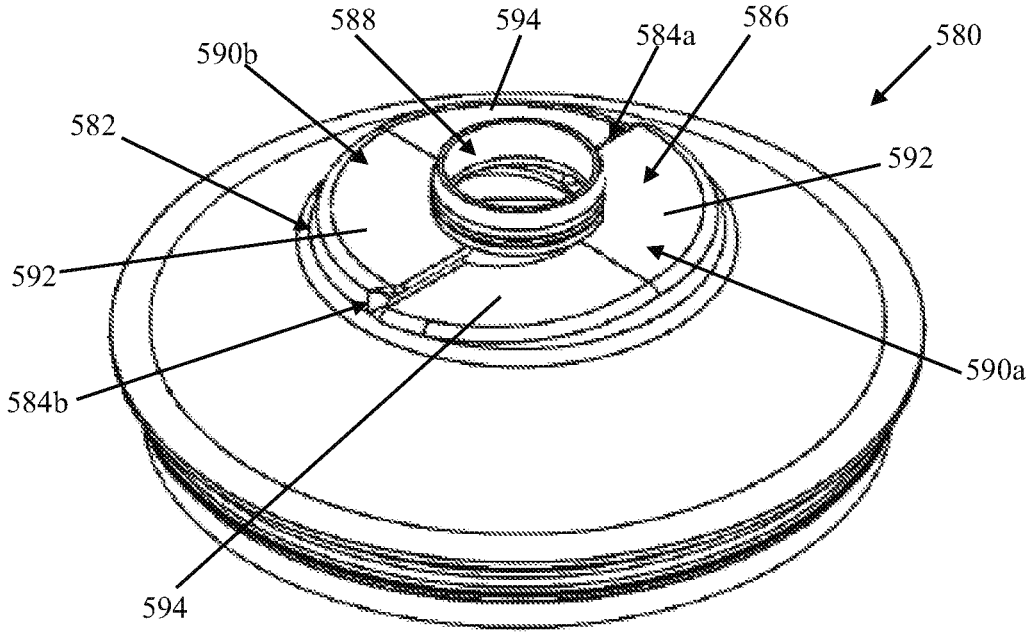
FIG. 18A is a perspective view of another lid in accordance with principles of the present disclosure.
Figure 18B:
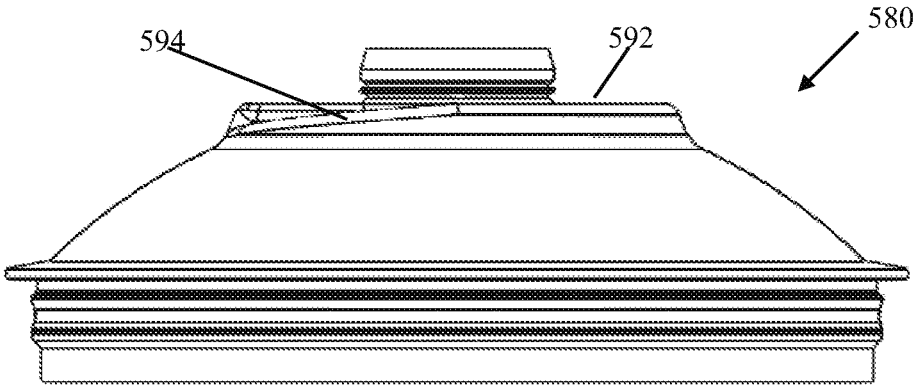
FIG. 18B is a side view of the lid of FIG. 18A.
Figure 18C:
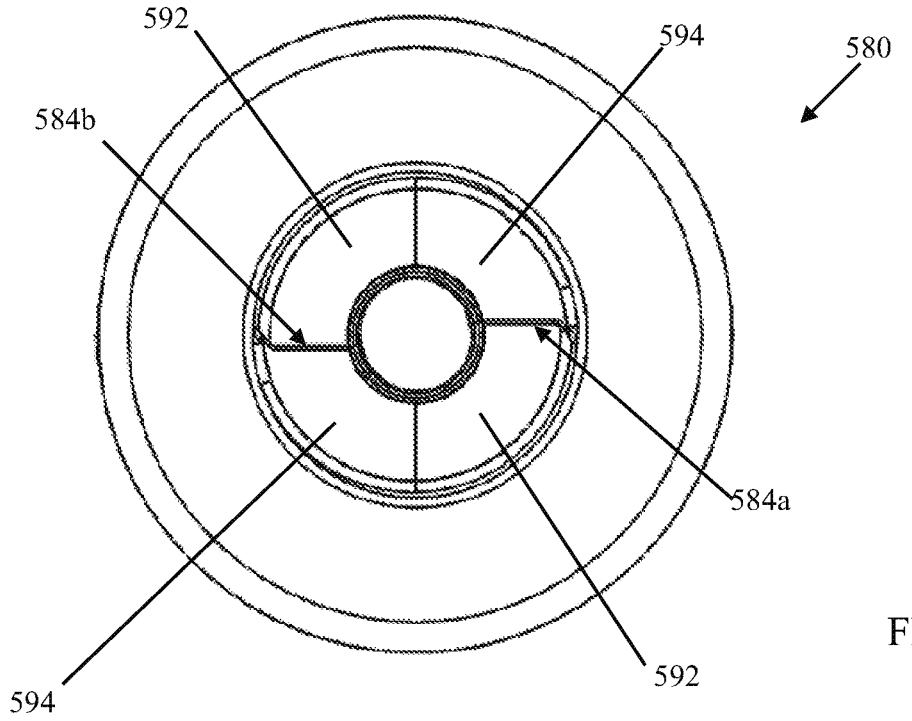
FIG. 18C is a top view of the lid of FIG. 18C.
Figure 18D:
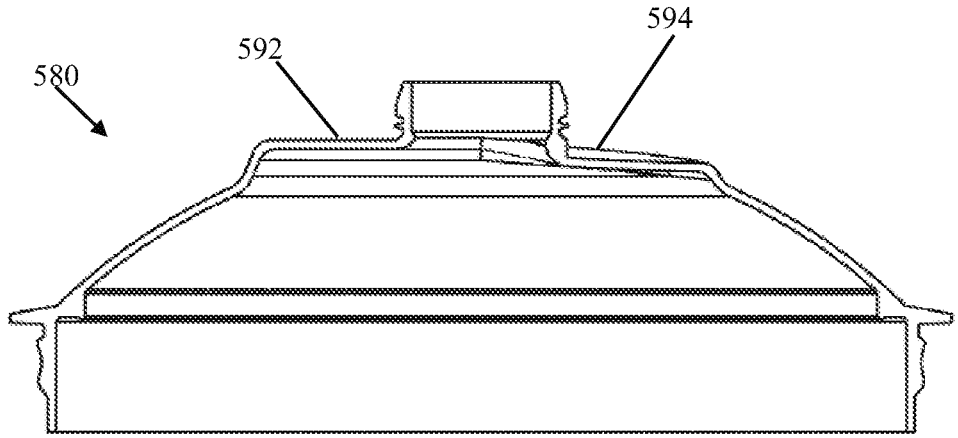
FIG. 18D is a cross-sectional view of the lid of FIG. 18A.

With continued rotation of the adaptor 412 relative to the lid 410 (and/or vice-versa), the shim body 550 of each lock structure 502 will become frictionally and mechanically locked within the capture region 456 of a respective one of the retention structures 442. FIGS. 17A and 17B illustrate a locked state of the lid 410 and the adaptor 412. The contact face 518 of the adapter 412 has further rotated relative to and along the ramp surface 460, achieving more complete engagement of the lock structures 502 within the retention structures 442. An abutting interface between the tab 534 (one of which is visible in FIG. 17A) of each track segment 532 against the shoulder 466 (one of which is visible in FIG. 17A) prevents over rotation of the adaptor 412 relative to the lid 410 (and/or vice-versa) and serves to stabilize the connection assembly. The cross-sectional view of FIG. 17C illustrates one of the wedge bodies 550 lodged within the capture region 456 (reference generally) of one of the retention structures 442, and reflects that a shape and spatial orientation of the wedge body 550 mimics that of the capture region 456. In the locked state, the abutment face 552 of the shim body 550 bears against the contact surface 450 of the floor 444, and the locking face 554 of the shim body 550 bears against the engagement surface 454 of the wedge body 448. The downward angular orientation of the contact and engagement surfaces 450, 454, and of the abutment and locking faces 552, 554, relative to a plane perpendicular to the axis of rotation dictates that as the shim body 550 progressively advances through the capture region 456 (i.e., the first end 540 of the shim body 550 is progressively advanced from the first end 458 of the retention structure 442 to the second end 459), the adaptor 412 is pulled or drawn downwardly (relative to the orientation of FIG. 17C) on to the lid 410, promoting a liquid-tight seal between the components. Other sealing features can be provided as with other embodiments above.

While the above descriptions have provided the complementary second connection format 404 (referenced generally in FIG. 13) as part of the adaptor 412, other configurations are also acceptable. For example, the second connection format 404 can be permanently assembled to or provided as an integral part of a spray gun (e.g., the second connection format 404 as described above can be provided as or at the inlet port 48 (FIG. 1) of the spray gun 30 (FIG. 1)). In addition, the location of the first and second connection formats 402, 404 can be reversed. In other embodiments, then, the second connection format 404 can be formed or provided with the lid 410, and the first connection format 402 can be formed or provided with a spray gun inlet (e.g., adaptor, integral spray gun inlet port, etc.).

The tapered or ramp-type interface provided by the ramp surface 460 as described above can be achieved with other geometries or designs in accordance with principles of the present disclosure. For example, portions of another lid 580 in accordance with principles of the present disclosure are shown in FIGS. 18A-18D. The lid 580 is akin to any of the lids described in the present disclosure, and includes a platform 582. For ease of understanding, the connection format features described above are omitted from the illustrations of FIGS. 18A-18D. First and second undercuts 584*a*, 584*b* are formed along a face 586 of the platform 582 commensurate with the explanations above. The face 586 revolves about a spout 588 and along which a rotational direction can be designated (e.g., clockwise or counterclockwise). Relative to a clockwise direction, a first section 590*a* of the face 586 can be viewed as circumferentially extending from the first undercut 584*a* to the second undercut 584*b*, and a second section 590*b* can be viewed as circumferentially extending from the second undercut 584*b* to the first undercut 584*a*. Each of the sections 590*a*, 590*b* includes a flat segment 592 and a ramp segment 594. The ramp segment 594 is akin to the ramp surface 460 (FIG. 14A) described above, whereas the flat segment 592 is substantially planar (e.g., a plane of the ramp segment 594 is oblique to a plane of the flat segment 592). With this construction, the tapering or ramp-type interfaces described above can be provided, and the lid 580 is designed to promote ease of manufacture by molding.

Figure 19:
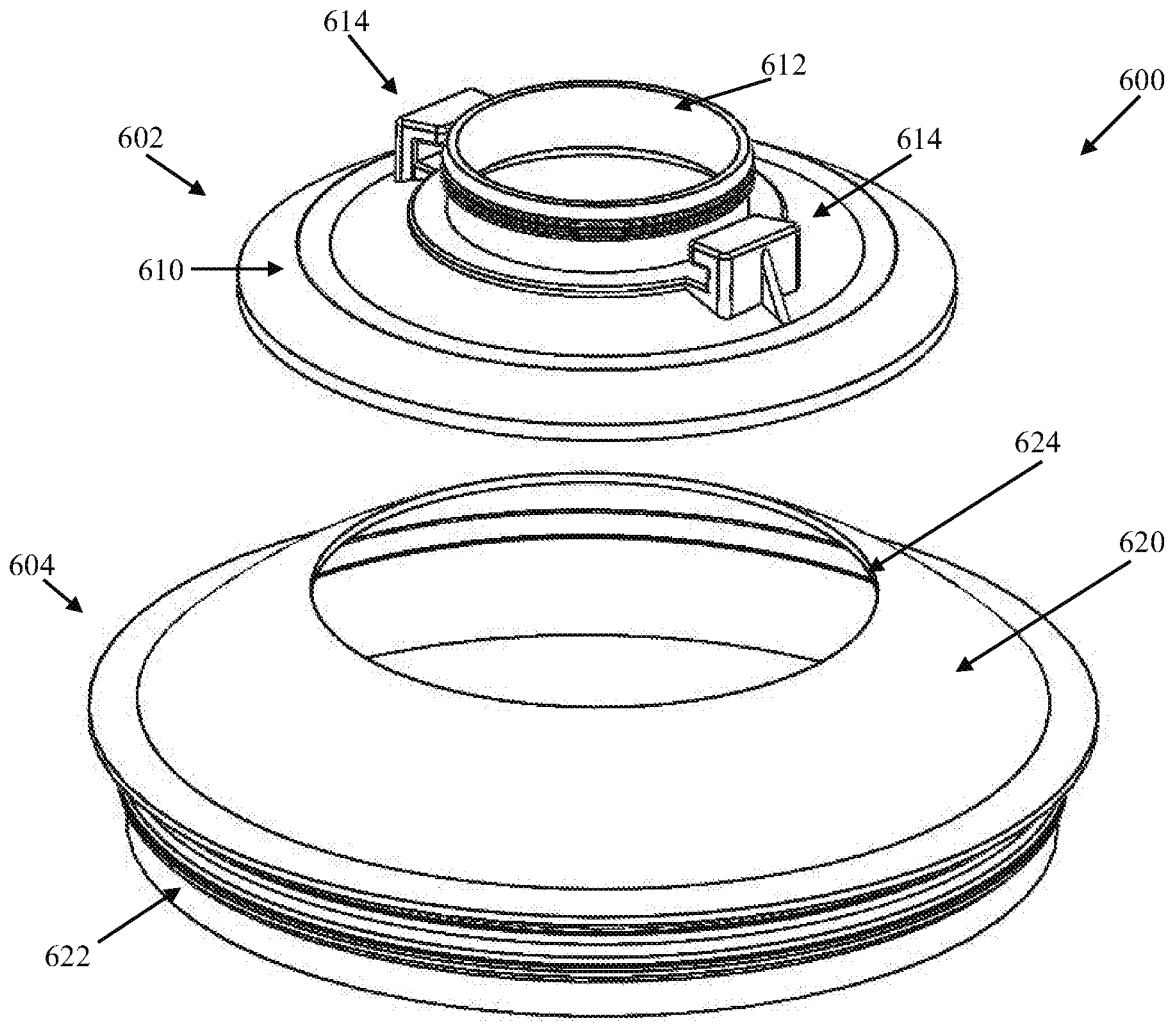
FIG. 19 is an exploded perspective view of a modular lid assembly incorporating a connection format in accordance with principles of the present disclosure.

Any of the complementary connection formats described in the present disclosure may be formed integrally with a remainder of the corresponding lid. Alternatively, these components may be initially formed as a separate, modular part or assembly comprising connection geometry to permit connection to a remainder of the lid. For example, a modular lid assembly 600 is shown in FIG. 19 and includes a modular liquid outlet 602 and a modular lid base 604. The modular components 602, 604 are separately formed and subsequently assembled. In general terms, the modular liquid outlet 602 includes a stage 610, a liquid outlet 612 and components of a connection format 614 (referenced generally). The stage 610 is sized and shaped in accordance with a corresponding feature of the modular lid base 604 described below, and supports the liquid outlet 612 and the connection format 614. The liquid outlet 612 and the connection format 614 can assume any of the forms described above, and in the non-limiting example of FIG. 19, can be the liquid outlet 64 (FIG. 4A) and the first connection format 56 (FIG. 4A) as described above. Any other connection format described herein can alternatively be incorporated into the modular liquid outlet 602.

The modular lid base 604 generally includes a wall 620 and a rim 622 projecting from the wall 620. The wall 620 forms a central opening 624, and is sized and shaped in accordance with a size and shape of the stage 610. The central opening 624 can assume various shapes and sizes, but is generally configured such that an outer diameter of the opening 624 is greater than an inner diameter of the liquid outlet 612, and less than an outer diameter of the stage 610.

Assembly of the modular lid assembly 600 includes securing the stage 610 on to the wall 620, with the central opening 624 being open to the liquid outlet 612. The modular liquid outlet 602 is secured to the modular lid base 604 by way of welding and/or an adhesive or the like in some embodiments. In some embodiments, the adhesive joint and/or weld joint act to both retain and create a liquid-tight seal upon assembly of the modular liquid outlet 602 to the modular lid base 604. Other attachment techniques are also acceptable, such as quarter turn locking, provision of mechanical locking mechanisms, threaded, snap fit, other mechanical fasteners (e.g., screws, rivets and/or molded posts that are cold formed/hot formed and mushroomed down to hold/retain the component(s) in place and provide a suitable leak-proof seal).

Constructing the lid 600 using a modular liquid outlet 602 and a modular lid base 604 can provide an advantage of allowing more complex geometries to be feasibly created than may otherwise be possible using, e.g., injection molding. For example, in a given lid 600, it may be impossible to form a particular geometry in an injection molded part due to the locations of mold parting lies and the necessary trajectory of slides required to form certain features. However, if the lid 600 is split into modular components, tooling can be designed to directly access surfaces of each modular component that would not have been accessible on the one-piece lid. Thus, further geometric complexity can be achieved.

The modular lid components 602, 604 may also be constructed of different materials as desirable for the application. For example, it may be desirable to use an engineering plastic for the modular liquid outlet 602 (due the strength and tolerances required for a secure and durable connection to the spray gun), while lower cost polymers could be used for the modular lid base 604.

In other embodiments, the modular liquid outlet 602 provided as above could alternatively be attached or preassembled to the end of a paint supply line or pouch etc. and in turn connected to the spray gun paint inlet port. In this way, paint could be supplied directly to the spray gun without the need for the modular lid base 504 (or other reservoir components).

The spray gun reservoir connector systems of the present disclosure provide a marked improvement over previous designs. By locating various components of the connector formats outside or apart from the liquid outlet (or spout)

formed by the lid, an inner diameter of the spout can be increased as compared to conventional designs. This, in turn, may improve flow rates through the spout. Further, the connector systems of the present disclosure lower a center of gravity of the reservoir relative to the spray gun as compared to conventional designs. Also, a more stable and robust connection is provided, minimizing possible "teetering" of the reservoir relative to the spray gun during a spraying operation.

Although the present disclosure has been described with reference to preferred embodiments, workers skilled in the art will recognize that changes can be made in form and detail without departing from the spirit and scope of the present disclosure.

What is claimed is:

1. A spray gun reservoir connector system comprising:

a reservoir including a lid;

a spray gun inlet;

a first connector format provided with one of the lid and the spray gun inlet, the first connector format including a plurality of retention structures each defining a capture region, wherein the retention structures are collectively arranged in a circular pattern and are circumferentially spaced from one another; and a second connector format provided with the other of the lid and the spray gun inlet, the second connector format including a plurality of lock structures each including a shim body configured to selectively interface with the capture region of a respective one of the retention structures, wherein the lock structures are collectively arranged in a circular pattern and are circumferentially spaced from one another, wherein the first connector format includes a platform defining a contact surface, and the retention structures project longitudinally away from the contact surface, wherein the platform defines a plurality of undercuts in the contact surface, and wherein the connector formats are configured to provide wedged engagement between the lock structures and corresponding ones of the retention structures upon rotation of the spray gun inlet relative to the lid.

2. The connector system of claim 1, wherein the lid further includes a liquid outlet having a spout, and further wherein the connector format associated with the lid is radially spaced outside of the spout.

3. The connector system of claim 2, wherein the spout has an inner diameter of not less than 22 mm.

4. The connector system of claim 1, wherein the first connector format is provided with the lid and the second connector format is provided with the spray gun inlet.

5. The connector system of claim 1, wherein the retention structures each include a contact surface and wedge body defining an engagement surface, and further wherein the engagement surface is longitudinally spaced from the contact surface, and even further wherein the contact surface and the engagement surface combine to define at least a portion of the corresponding capture region.

6. The connector system of claim 1, wherein the shim body of each of the lock structures defines an abutment face opposite a locking face, and further wherein at least one of the abutment face and the locking face defines a plane that is arranged at an angle to a plane perpendicular to an axis of rotation of the system.

7. A spray gun reservoir component comprising:

a liquid outlet comprising a spout;

a first connector format radially spaced outside of the spout, the first connector format comprising:

a face revolving around the spout along a rotational direction, the face comprising a first section circumferentially extending in the rotational direction along a first flat segment and a first ramped segment to a second undercut, wherein the first section circumferentially extends from a first undercut to the second undercut.

8. The spray gun reservoir component of claim 7 wherein the face comprises a second section circumferentially extending in the rotational direction from the second undercut to the first undercut.

9. The spray gun reservoir component of claim 8 wherein the second section of the face circumferentially extends in the rotational direction along a second flat segment and a second ramped segment to a first undercut.

10. The spray gun reservoir component of claim 9 wherein the second ramped segment tapers longitudinally downward from the second flat segment to the first undercut.

11. The spray gun reservoir component of claim 8 further comprising a second retention structure corresponding to the second section of the face.

12. The spray gun reservoir component of claim 11 wherein the second retention structure defines a second capture region.

13. The spray gun reservoir component of claim 11, wherein the first and second retention structures are arranged about, and radially spaced from, the spout.

14. The spray gun reservoir component of claim 11, wherein the first and second retention structures each include a contact surface and wedge body defining an engagement surface, and further wherein the engagement surface is longitudinally spaced from the contact surface, and the contact surface and the engagement surface combine to define at least a portion of the corresponding capture region.

15. The spray gun reservoir component of claim 7 further comprising a first retention structure corresponding to the first section of the face.

16. The spray gun reservoir component of claim 15 wherein the first retention structure defines a first capture region.

17. The spray gun reservoir component of claim 7, wherein the spout has an inner diameter of not less than 22 mm.

* * * * *